US011749922B2

(12) United States Patent
Hake

(10) Patent No.: US 11,749,922 B2
(45) Date of Patent: Sep. 5, 2023

(54) DUAL-SIDED CONNECTOR FOR PRINTED CIRCUIT BOARD

(71) Applicant: GE INFRASTRUCTURE TECHNOLOGY LLC, Greenville, SC (US)

(72) Inventor: Mariah Inez Hake, Broomfield, CO (US)

(73) Assignee: GE INFRASTRUCTURE TECHNOLOGY LLC, Greenville, SC (US)

( * ) Notice: Subject to any disclaimer, the term of this patent is extended or adjusted under 35 U.S.C. 154(b) by 170 days.

(21) Appl. No.: 17/406,870

(22) Filed: Aug. 19, 2021

(65) Prior Publication Data

US 2022/0069494 A1 Mar. 3, 2022

Related U.S. Application Data

(60) Provisional application No. 63/072,968, filed on Sep. 1, 2020.

(51) Int. Cl.
*H01R 13/621* (2006.01)
*H01R 12/71* (2011.01)
(Continued)

(52) U.S. Cl.
CPC ..... *H01R 12/716* (2013.01); *H01R 12/714* (2013.01); *H01R 13/05* (2013.01);
(Continued)

(58) Field of Classification Search
CPC .... H01R 12/716; H01R 12/714; H01R 13/05; H01R 13/11; H01R 13/405; H01R 13/502;
(Continued)

(56) References Cited

U.S. PATENT DOCUMENTS 5,281,166 A * 1/1994 Yu ..... H01R 12/7029 439/571
5,359,540 A * 10/1994 Ortiz ..... H02J 13/00012 307/115
(Continued)

FOREIGN PATENT DOCUMENTS

CN 103092308 A 5/2013
CN 104125708 A 10/2014

OTHER PUBLICATIONS

International Search Report received for PCT International Application No. PCT/US2010/045149, dated Apr. 12, 2011, 4 pages.
(Continued)

*Primary Examiner* — Abdullah A Riyami
*Assistant Examiner* — Nelson R. Burgos-Guntin
(74) *Attorney, Agent, or Firm* — Armstrong Teasdale LLP

(57) ABSTRACT

A dual-sided connector is provided. The dual-sided connector can include a first housing including a male connection port. The dual-sided connector can also include a second housing opposite the first housing. The second housing can include a female connection port. The dual-sided connector can also include a plurality of pins included in the second housing. The plurality of pins can extend through the first housing and the second housing. Each pin of the plurality of pins can include a male end terminating in the first housing and a female end terminating in the second housing. The dual-sided connector can also include a plurality of fasteners coupling the first housing and the second housing. Systems and methods of assembly are also provided.

20 Claims, 21 Drawing Sheets

(51) Int. Cl.
*H01R 13/405* (2006.01)
*H01R 13/11* (2006.01)
*H01R 13/629* (2006.01)
*H01R 13/05* (2006.01)
*H01R 13/502* (2006.01)

(52) U.S. Cl.
CPC ..... *H01R 13/11* (2013.01); *H01R 13/405* (2013.01); *H01R 13/502* (2013.01); *H01R 13/629* (2013.01)

(58) Field of Classification Search
CPC ..... H01R 13/629; H01R 31/06; H01R 12/58; H01R 12/7047; H01R 12/7082; H01R 13/512; H01R 12/73
See application file for complete search history.

(56) References Cited

U.S. PATENT DOCUMENTS 5,695,362 A * 12/1997 Hillbish ..... H01R 13/6595 439/541.5
5,707,242 A 1/1998 Mitra et al.
5,772,453 A * 6/1998 Tan ..... H01R 13/658 439/79
5,859,766 A * 1/1999 Van Scyoc ..... H05K 5/0052 361/752
5,966,292 A 10/1999 Amberg et al.
6,341,966 B1 1/2002 Takada et al.
6,478,616 B1 * 11/2002 Yeh ..... H01R 24/58 439/541.5
6,482,042 B1 * 11/2002 Tupper ..... H01R 31/06 439/638
7,128,616 B1 * 10/2006 Orr ..... H01R 13/518 439/651
8,582,302 B2 * 11/2013 Peterson ..... H05K 7/14 29/401.1
9,583,884 B1 * 2/2017 Wang ..... H01R 13/03
9,864,154 B1 * 1/2018 Zer ..... G02B 6/4278
10,205,258 B1 2/2019 Lee et al.
10,763,612 B1 * 9/2020 Soroka ..... H01R 13/5213
2003/0194910 A1 * 10/2003 Stoner ..... H01R 31/06 439/638
2008/0214038 A1 * 9/2008 Poulin ..... H01R 13/5829 439/345
2008/0227329 A1 * 9/2008 Klein ..... H01R 4/2425 370/366
2009/0130866 A1 * 5/2009 Huang ..... H01R 12/716 439/55
2009/0149073 A1 * 6/2009 Xiang ..... H01R 13/6595 439/638
2009/0221187 A1 * 9/2009 Daly ..... H01R 31/06 439/660
2009/0298324 A1 12/2009 Liu
2010/0048037 A1 * 2/2010 Wormsbecher ..... H05K 7/1492 439/32
2010/0068932 A1 * 3/2010 Tsai ..... H01R 13/6215 439/607.01
2010/0248503 A1 9/2010 Kang et al.
2010/0284154 A1 * 11/2010 Caron ..... G01D 21/00 361/728
2011/0178609 A1 * 7/2011 Parker ..... G05B 15/02 700/12
2012/0196473 A1 * 8/2012 Foung ..... H01R 4/2416 439/404
2013/0120941 A1 * 5/2013 Peterson ..... H05K 7/1492 29/401.1
2016/0164203 A1 * 6/2016 Barker ..... F42B 4/24 439/78
2017/0010303 A1 * 1/2017 Salopek, II ..... G01R 1/0416
2017/0149158 A1 * 5/2017 Park ..... H01R 13/2421
2017/0271830 A1 * 9/2017 Schaper ..... H05K 1/0245
2018/0165053 A1 * 6/2018 Kuo ..... G06F 3/1454
2019/0245310 A1 * 8/2019 Medina ..... H01R 12/714
2020/0014163 A1 * 1/2020 Kwon ..... H05K 1/145
2021/0391677 A1 * 12/2021 Mu ..... H01R 12/721
2022/0069494 A1 * 3/2022 Hake ..... H01R 13/11

OTHER PUBLICATIONS

Boesing Danny, "Board Stacking Interconnects For Unusual Applications", The Samtec Blog, Jul. 14, 2016.
International Search Report and Written Opinion received for PCT International Application No. PCT/US2021/071310, dated Dec. 16, 2021, 11 pgs.

* cited by examiner

DUAL-SIDED CONNECTOR FOR PRINTED CIRCUIT BOARD

RELATED APPLICATION

This application claims priority under 35 U.S.C. § 119(e) to U.S. Provisional Application No. 63/072,968, filed Sep. 1, 2020, the entire contents of which are hereby expressly incorporated by reference herein.

TECHNICAL FIELD

The subject matter described herein relates to a serial connector for a printed circuit board (PCB).

BACKGROUND

Circuit board connectors can be used to couple two or more circuit boards to each other. Circuit boards can be used in an industrial operating environment, such as an oil and gas production facility or a power generation facility, in relation to one or more industrial control systems which can be used to operate and control continuous or discrete control processes. Control systems can be configured to utilize multiple PCBs as Input/output (I/O) boards. The I/O boards can be configured in hardware cabinets and can be connected to one another by cables, such as serial cables. It can be advantageous to utilize cabinet space efficiently without requiring redesign of the boards and to reduce the complexity of serial cable configurations when coupling multiple boards together.

SUMMARY

In one aspect, a dual-sided connector is provided. In an embodiment, the dual-sided connector can include a first housing including a male connection port. The dual-sided connector can also include a second housing opposite the first housing. The second housing can include a female connection port. The dual-sided connector can also include a plurality of pins included in the second housing. The plurality of pins can extend through the first housing and the second housing. Each pin of the plurality of pins can include a male end terminating in the first housing and a female end terminating in the second housing. The dual-sided connector can also include a plurality of fasteners coupling the first housing and the second housing.

In another embodiment, the male connection port can couple with a second female connection port of a first adjacent dual-sided connector and the female connection port can couple with a second male connection port of a second adjacent dual-sided connector. In another embodiment, the dual-sided connector can be a D-subminiature connector.

In another embodiment, the male end of each pin of the plurality of pins can extend through a pin hole of a printed circuit board (PCB). In another embodiment, each pin of the plurality of pins can include a collar between the female end and the male end. The collar can abut the PCB when the first housing can be coupled to the second housing. In another embodiment, the male end of each pin of the plurality of pins can include a tapered portion.

In another embodiment, the first housing and/or the second housing can be formed via injection molding, machining, or a combination thereof. In another embodiment, the plurality of pins can be secured within the second housing via over-molding, insertion molding, or press fitting.

In another aspect, a dual-sided connector is provided. In an embodiment, the dual-sided connector can include a first housing including a female connection port. The dual-sided connector can also include a second housing opposite the first housing. The second housing can include a male connection port. The dual-sided connector can also include a first plurality of pins included in the first housing, the first plurality of pins extending through the first housing and into the second housing. Each pin of the first plurality of pins can include a female end terminating in the first housing and a tail end terminating in the second housing. The dual-sided connector can also include a second plurality of pins included in and extending through the second housing. Each pin of the second plurality of pins can include a socket end and a male end. The socket end can include a socket. The dual-sided connector can also include a plurality of fasteners coupling the first housing and the second housing.

In another embodiment, the male connection port can couple with a second female connection port of a first adjacent dual-sided connector and the female connection port can couple with a second male connection port of a second adjacent dual-sided connector. In another embodiment, the second housing can be a D-subminiature connector. In another embodiment, the tail end of each pin of the first plurality of pins can extend through a pin hole of a printed circuit board (PCB). In another embodiment, each pin of the first plurality of pins can include a collar between the female end and the tail end. The collar can abut the PCB when the first housing can be coupled to the second housing.

In another embodiment, the male end of each pin of the second plurality of pins can include a tapered portion. In another embodiment, the first housing and/or the second housing can be formed via injection molding, machining, or a combination thereof. In another embodiment, the first plurality of pins can be secured within the first housing via over-molding, insertion molding, or press-fitting and/or the second plurality of pins can be secured within the second housing via over-molding, insertion molding, or press fitting.

In another embodiment, the socket end can include a cavity and a plurality of flange structures within the cavity. In another embodiment, the tail end of a respective pin of the first plurality of pins can be received within the cavity and can be secured within the cavity by the plurality of flange structures.

In another aspect, a system is provided. In an embodiment, the system can include a first dual-sided connector. The first dual-sided connector can include a first housing, which can include a female connection port. The first dual-sided connector can include a second housing, which can include a male connection port. The first dual-sided connector can include a first plurality of pins included in the first housing. The first plurality of pins extending through the first housing and into the second housing. Each pin of the first plurality of pins can include a female end terminating in the first housing and a tail end terminating in the second housing. The first dual-sided connector can also include a second plurality of pins included in and extending through the second housing. Each pin of the second plurality of pins can include a socket end and a male end, the socket end including a socket. The first dual-sided connector can also include a plurality of fasteners coupling the first housing and the second housing. The system can also include at least two printed circuit boards (PCBs). The first dual-sided connector can be coupled to a first PCB via the plurality of fasteners extending through holes in the first PCB. The male connection port of the first dual-sided connector can be coupled to the first PCB, which can be coupled to a second female connection port of a second dual-sided connection port that can be coupled to a second PCB that can be adjacent to the first PCB.

In another embodiment, the system can be coupled to a control system via the male connection port of the first dual-sided connector or the second female connection port of the second dual-sided connector.

DESCRIPTION OF DRAWINGS

These and other features will be more readily understood from the following detailed description taken in conjunction with the accompanying drawings, in which.

Figure 1B:
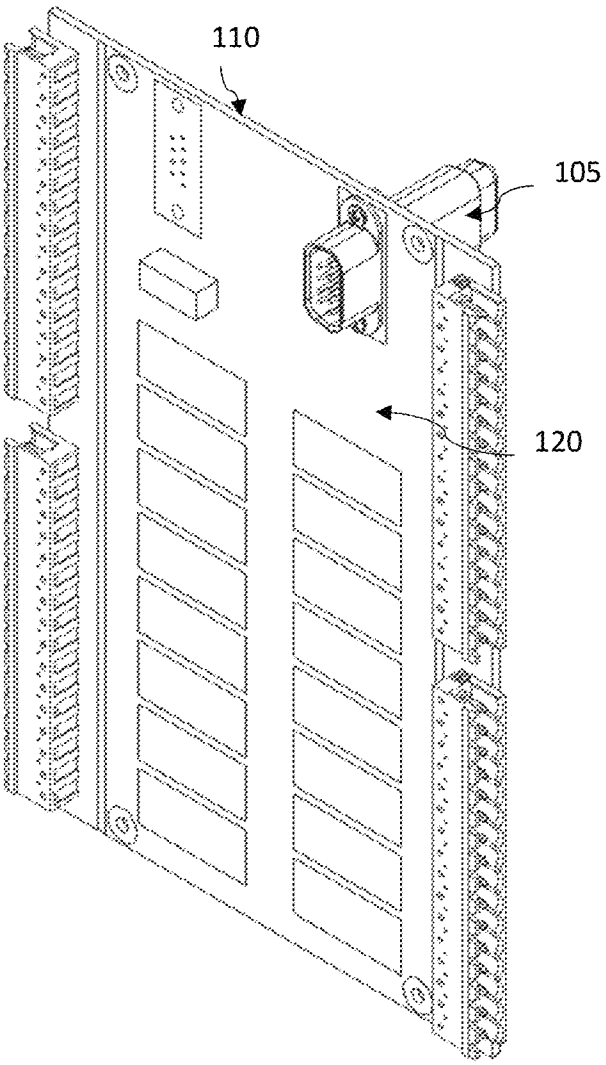
FIGS. 1A and 1B are diagrams illustrating isometric views of an embodiment of a dual-sided connector as described herein.

It is noted that the drawings are not necessarily to scale. The drawings are intended to depict only typical aspects of the subject matter disclosed herein, and therefore should not be considered as limiting the scope of the disclosure.

DETAILED DESCRIPTION

Control systems used in a wide variety of industrial operating environments, such as an oil and gas production facility or a power generation facility, can be configured with PCBs used to transmit data for controlling, maintaining, monitoring and otherwise communicating with the field devices. For example, a control system can be configured to control and communicate with a steam turbine in a pulp and paper plant, a well pump motor at a well site in an oil refinery facility, or an exciter unit at a hydropower facility. Control systems can include computing devices, configured in a network, to communicate with the field devices. As control system configurations expand and additional field devices are added, PCB configuration requirements can change and operating footprints be reduced. As a result, it can be challenging to accommodate configurations of multiple PCBs in a particular hardware cabinet in a manner that is user-friendly for control system operators and maintenance personnel.

Currently, PCBs with single-sided serial connectors can be configured and coupled using serial cables. Often, custom serial cables are required, which can be time-consuming, and costly to manufacture and can introduce additional points of failure for the PCB. Additional installation time, extended operational down time, and specialized resources can be required to couple multiple PCBs via single-sided serial connections within or between control systems, which can have significant impact on the productivity and profitability of an industrial operating environment.

Circuit board connectors can be mounted to a single side of a circuit board or PCB. As a result of this single-sided configuration, a cable can be required to couple one board to another. When a large number of PCBs are to be coupled, a large number of complex cable configurations can be required. For example, boards can be communicatively linked via daisy-chained serial cables, which can require customized design and manufacture to be implemented in systems requiring a large number of boards. Such cables can introduce multiple points of failure due to the need to replicate numerous connection interfaces between coupled boards. In addition, the serial cables can be cumbersome and bulky, and can require increasingly larger hardware cabinets to house the cables, which can make it challenging to reduce the footprint of existing configurations of previously installed boards and to achieve desired configurations of boards to be installed in space-limited scenarios or footprints. Stacking multiple boards can be limited by the use of existing single-sided connectors and bulky connection cables. Such limitations can increase the cost and complexity of system deployment and maintenance.

In general, devices, system, and methods are provided herein for connecting multiple PCBs utilizing a dual-sided connector. The dual-sided connector includes dual-sided pins extending within the dual-sided connector and through a through hole of the PCB board. The dual-sided connector can include a male serial connection port on one side and female serial connection port opposite of the male serial connection port. The dual-sided connector described herein allows connection to the PCB through either side or both sides of the connector using existing through holes configured on the PCB for single-sided connectors. As such, the dual-sided connector provides a reduced footprint for new or retrofit installations of PCBs. The dual-sided connected described herein can reduce the number of cables required to couple PCBs, which can provide easier assembly, deployment, and customer interface to systems with multiple PCBs without requiring redesign of serial connection features on a PCB. A further benefit can include increased communication and power transmission speeds due to removing the need to lengthy, complex serial cables connecting PCBs.

Embodiments of systems, devices, and methods for coupling multiple PCBs of control systems are discussed herein. However, embodiments of the disclosure can be employed for coupling PCBs in other computing or data processing systems configured with multiple PCBs without limitation.

Figure 1A:
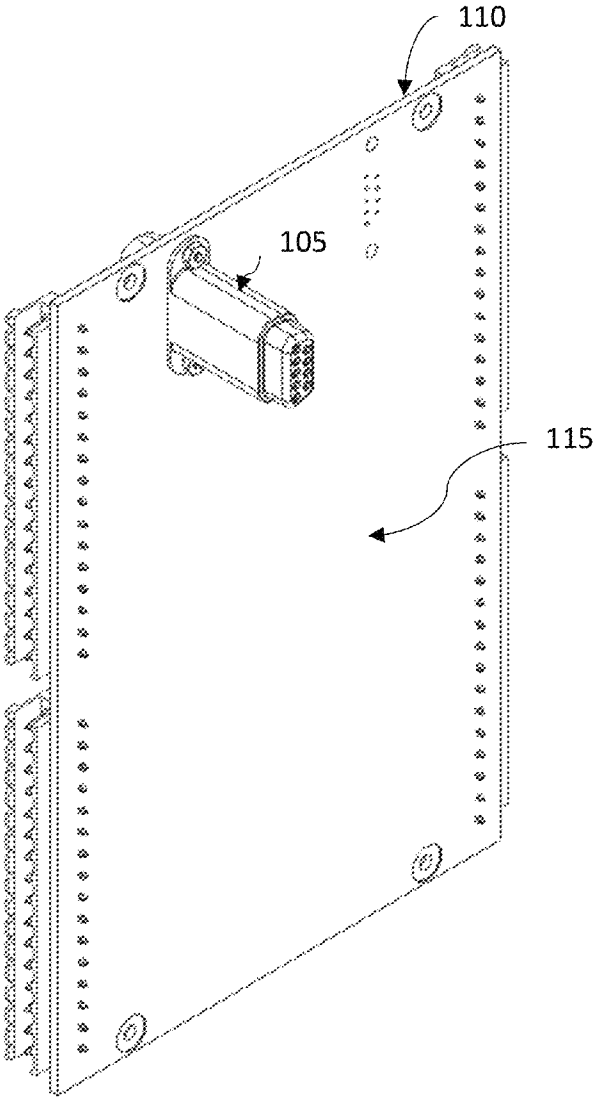

FIG. 1A is a diagram illustrating an isometric view of an exemplary embodiment of a dual-sided connector 105. The dual-sided connector 105 can be configured within a through hole of a PCB 110. The through hole of the PCB can be plated through holes. As shown in FIG. 1A, the dual-sided connector 105 can extend through the PCB 110 to the rear side 115 of the PCB 110. As shown in FIG. 1B, the dual-sided connector 105 can extend through the front side 120 of the PCB 110. The dual-sided connector 105 can be configured to utilize the same PCB through hole configured on the PCB 110 for single-sided connectors. The dual-sided connector 105 can be configured as a serial connector to serially link or couple two or more PCBs 110 to each other, thereby allowing multiple PCBs and the PCB circuits respectively configured on each PCB to share power and data transmissions efficiently without complex, custom cabling configurations.

Figure 2B:
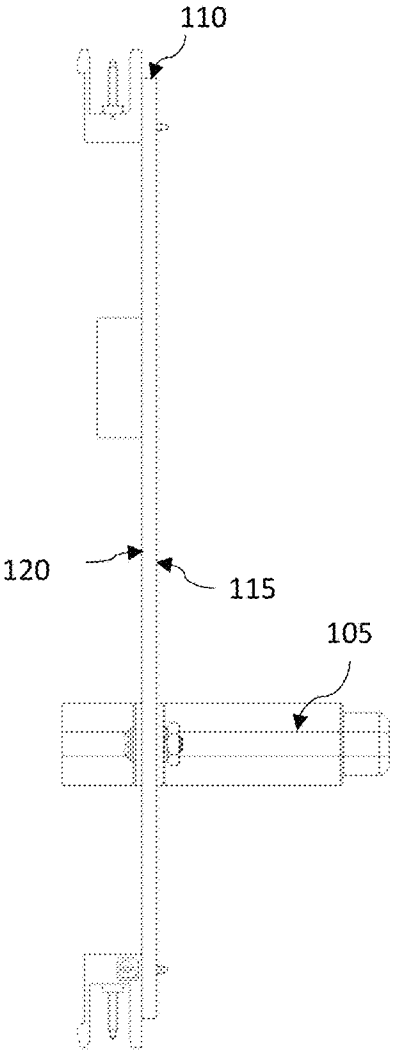
FIG. 2B is a diagram illustrating a top-down view of the exemplary embodiment of the dual-sided connector shown in FIGS. 1A and 1B.
Figure 2A:
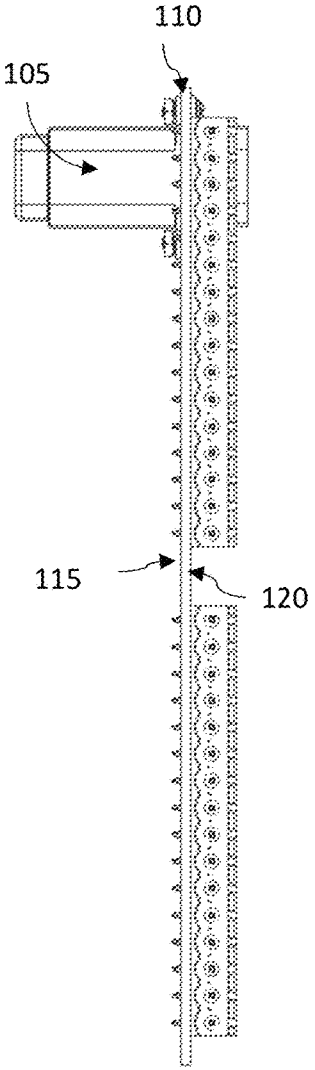
FIG. 2A is a diagram illustrating a side view of the exemplary embodiment of the dual-sided connector shown in FIGS. 1A and 1B.

FIG. 2A is a diagram illustrating a side view of the exemplary embodiment of the dual-sided connector shown in FIGS. 1A and 1B. FIG. 2B is a diagram illustrating a top-down view of the exemplary embodiment of the dual-sided connector shown in FIGS. 1A and 1B. As shown in FIGS. 2A and 2B, the dual sided connector extends through the PCB 110.

Figure 3:
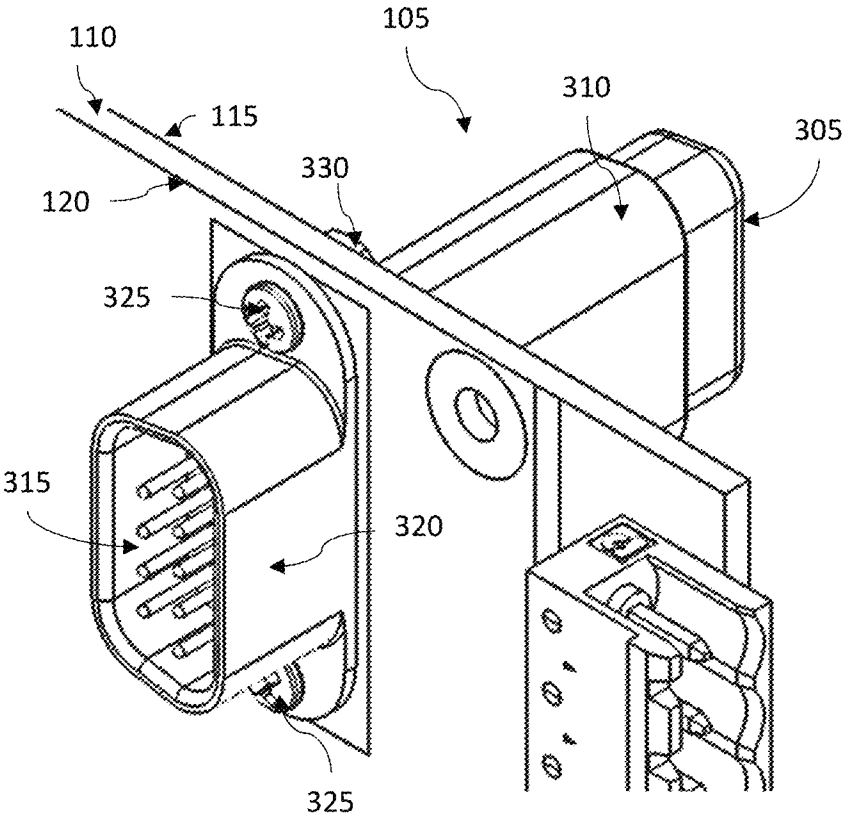
FIG. 3 is a diagram illustrating an isometric close-up view of the exemplary embodiment of the dual-sided connector shown in FIGS. 1A and 1B.

FIG. 3 is a diagram illustrating an isometric close-up view of the exemplary embodiment of the dual-sided connector shown in FIGS. 1A and 1B. As shown in FIG. 3, the dual-sided connector 105 can include a female connection port 305 configured with respect to a rear side 115 of the PCB 110. A female connection port housing 310 can house the female connection port 305. The dual-sided connector 105 can also include a male connection port 315 configured with respect to a front side 120 of the PCB 110. The male connection port 315 is housed by a male connection port housing 320. In some embodiments, the orientation of the dual-sided connector 105 can be transposed with respect to the PCB 110. For example, in some embodiments, the female connection port 305 can be configured with respect to the front side 120 of the PCB 110 and the male connection port 315 can be configured with respect to the rear side 115 of the PCB 110.

As shown in FIG. 3, the male connection port housing 320 can be positioned to surround a plurality of pins configured within the dual-sided connector 105. A portion of the pins can be exposed within the male connection port housing 320. The male connection port housing 320 can be attached to the PCB 110 via a plurality of bolts 325. The bolts 325 can extend through the PCB 110 and can secure the dual-sided connector 105 to the PCB via a nut 330 threaded onto the bolt 325. In some embodiments, the male connection port housing 320 can be secured to the PCB 110 via rivets or via a press-on, friction fit connection with bolts 325. The female connection port housing 310 and the male connection port housing 320 can be formed via injection molding, machining, or a combination thereof. The connection port housings 310 and 320 can be configured to receive and secure the pins within the connection port housings 310 and 320 via overmolding, insertion-molding, or press-fitting.

Figure 4:
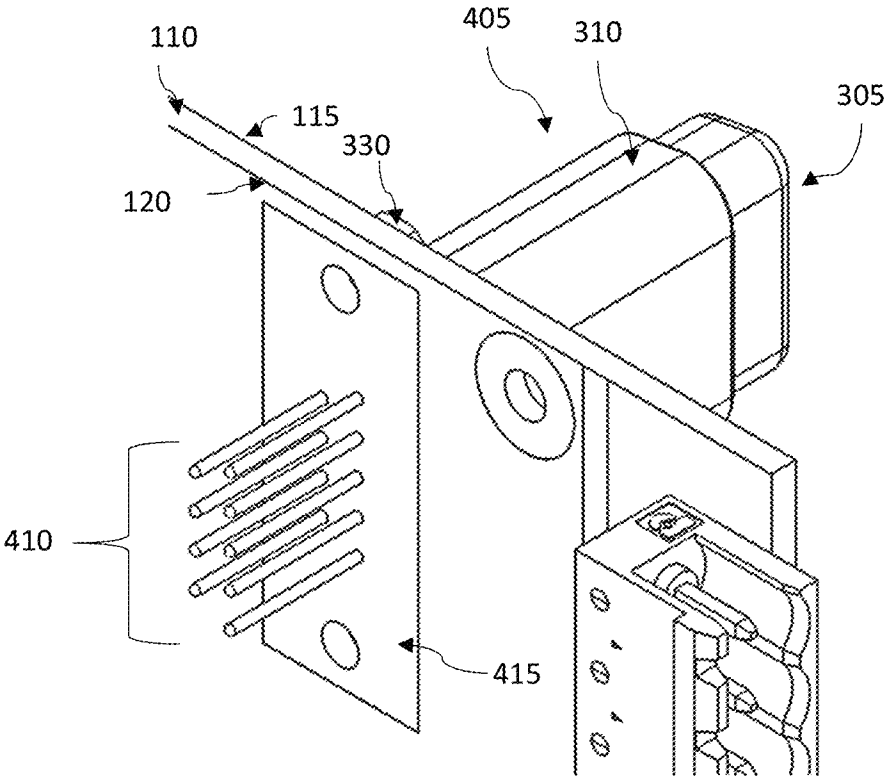
FIG. 4 is a diagram illustrating an isometric view of another exemplary embodiment of the dual-sided connector shown in FIGS. 1A and 1B.

FIG. 4 is a diagram illustrating an isometric view of another exemplary embodiment of the dual-sided connector shown in FIGS. 1A and 1B. As shown in FIG. 4, the dual-sided connector 405 is identical to the dual-sided 105 shown in FIG. 3, except that male connection port housing 320 has been removed. The female connection port housing 310 and the pins 410 are formed as a single assembly configured to connect to the PCB. The male connection port housing 320 can be provided atop the pins 410 and is intended to guide insertion of an adjoining cable or connector into contact with the pins 410. The female connection port housing 310 can be secured to the PCB 110 by soldering the plurality of pins 410 to the PCB 110. In some embodiments, the female connection port housing 310 can be secured to the PCB 110 via one or more screws and nuts, rivets, or a press-on, friction fit connection with the PCB 110. The plurality of pins 410 can be seen extending from a pin plate 415 configured to secure the pins 410 to the PCB 110. The pin plate 415 can include a plurality of holes for the pins 410 to pass through a through hole of the PCB 110. The through hole of the PCB can be a plated through hole and can provide an electrical connection to the PCB 110 via the pins 410. The pin plate 415 can also include a plurality of holes for the bolts 325 to pass through the PCB 110.

Figure 5:
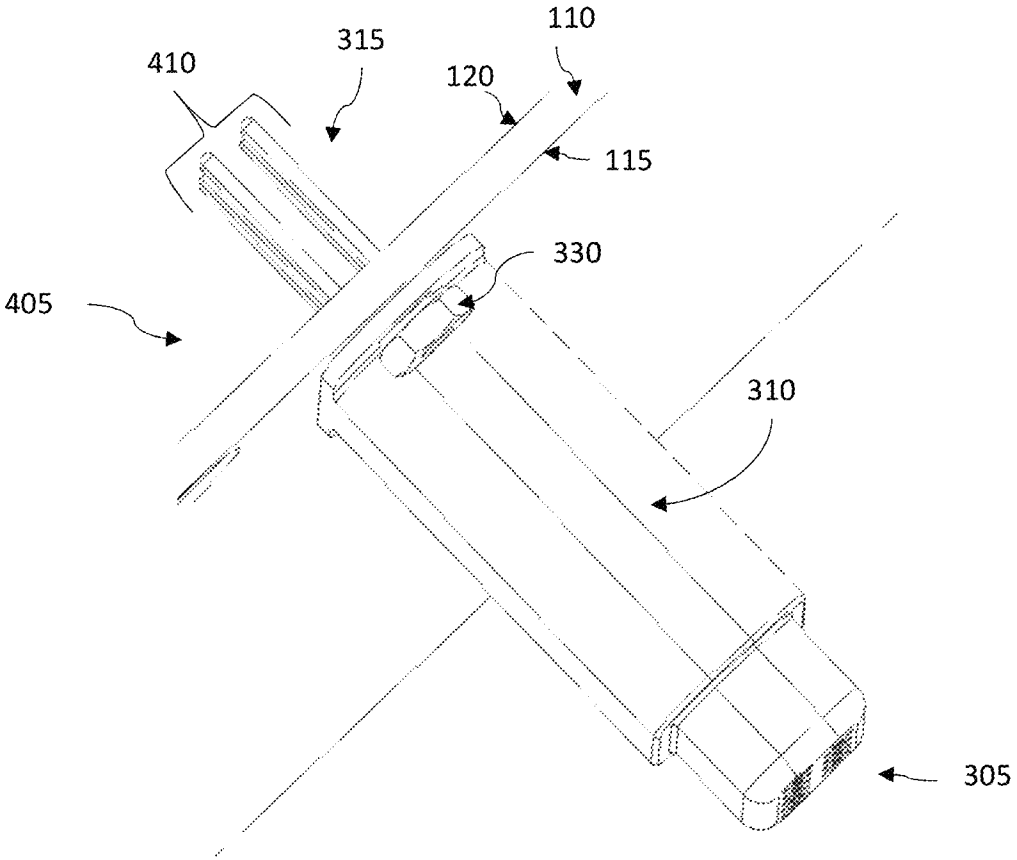
FIG. 5 is a diagram illustrating an isometric view of the exemplary embodiment of the dual-sided connector shown in FIG. 4.

FIG. 5 is a diagram illustrating another isometric view of the exemplary embodiment of the dual-sided connector 405 shown in FIG. 4. As shown in FIG. 5, the plurality of pins 410 can extend from the dual-sided connector 405 on the front side 120 of the PCB 110. In this way, the pins 410 can form a portion of the male connection port 315 show in FIG. 3. The pins 410 can also extend in the opposite direction through the rear side 115 of the PCB 110 to form the female connection port 305.

Figure 7:
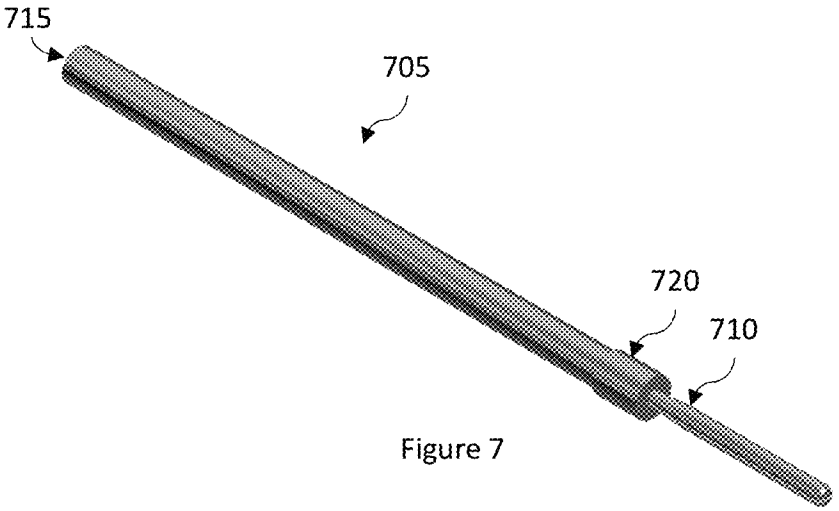
FIGS. 6-8 are diagrams illustrating exemplary embodiments of pins included in the dual-sided connector shown in FIGS. 1A-2B and FIGS. 4-5.
Figure 6:
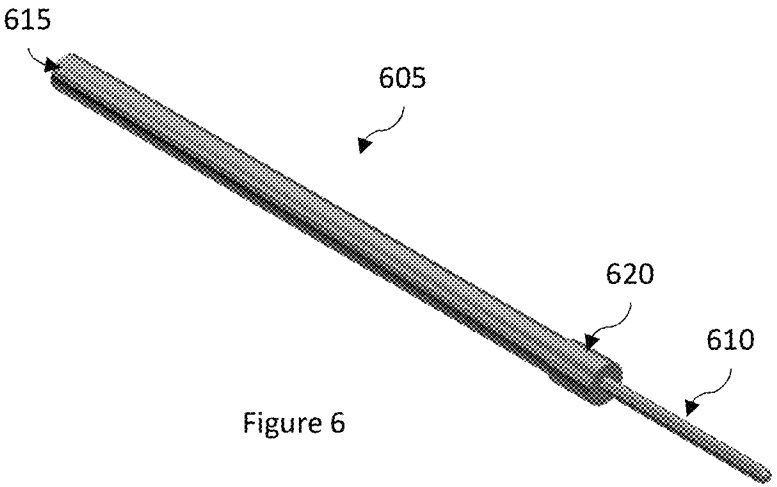
Figure 8:
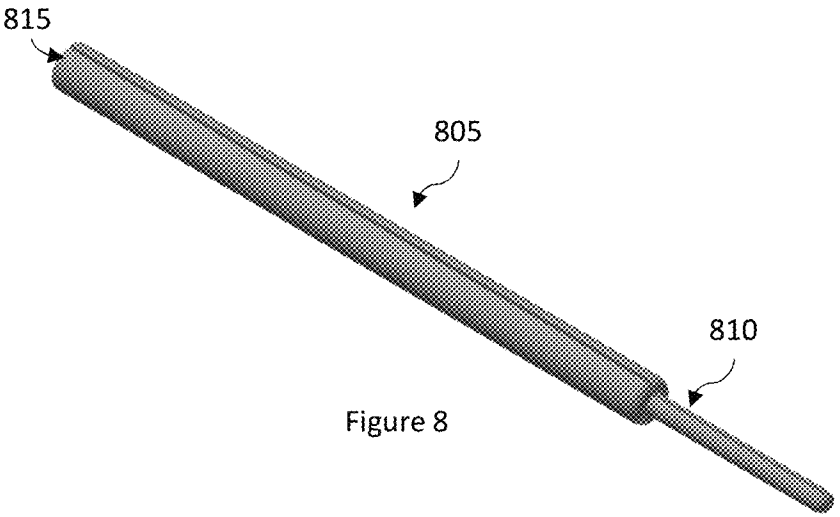

FIGS. 6-8 are diagrams illustrating exemplary embodiments of pins included in the dual-sided connector shown in FIGS. 1A-2B and FIGS. 4-5. The pins 605, 705, and 805 can correspond to individual pins included in the plurality of pins 410 shown in FIGS. 4 and 5. In the embodiment shown in FIG. 6, pin 605 can also include a pin machined from stock pin material. As shown in FIG. 6, pin 605 includes a first end 610 and a second end 615. The first end 610 can be configured within the male connection port 315 as shown in relation to FIG. 4. The second end 615 can be configured within the female connection port 305. The pin 605 can include a collar 620 configured to secure the pin 605 within the dual-sided connector described herein.

In the embodiment shown in FIG. 7, pin 705 can also include a pin machined from bar stock material. The machined pin 705 can include a first end 710 configured to provide a spring force to ensure contact between a male connection port 315 when adjoined with a female connection port 305. The first end 710 can have a slightly larger diameter and a slot extending along a portion of the first end 710 so that the first end 710 can compress when connected into the female connection port 305. The first end 710 can be configured within the male connection port 315 as shown in relation to FIG. 4. The second end 715 can be configured within the female connection port 305. The pin 705 can include a collar 720 configured to secure the pin 705 within the dual-sided connector and to abut the PCB 110. The first end 710 can be tapered such that a diameter of the pin at a distal end of the first end 710 is greater than a diameter of the pin at the collar 720. In this way, the pin 705 can fit through the plated through hole of the PCB 110. In some embodiments, the second end 715 can be configured to provide a spring force when an adjacent pin is received within the second end 715. For example, in such an embodiment, the first end 710 would be of uniform diameter and the second end 715 can include a slotted female end 715 that is configured to taper to a decreased diameter so that the spring force is exerted onto a first end 710 of an adjoining connector 105. In this way, the pin 705 can be formed with lower machining and finish tolerance requirements.

In the embodiment shown in FIG. 8, pin 805 can include a pin formed via rolling a sheet metal stock. As shown in FIG. 8, the pin 805 can include a first end 810. The first end 810 can be configured within the male connection port 315 as shown in relation to FIG. 4. The second end 815 can be configured within the female connection port 305. In some embodiments, a thin spring film insert of sheet metal, could be formed and placed inside of pins 605 or 805 at the second ends 615, 815, respectively, to ensure contact between the first ends 610, 810 and the second ends 615, 815 of an adjoining connector 105. In this way, the pins 605 and 805 can be formed with lower machining and finish tolerance requirements.

Figure 9:
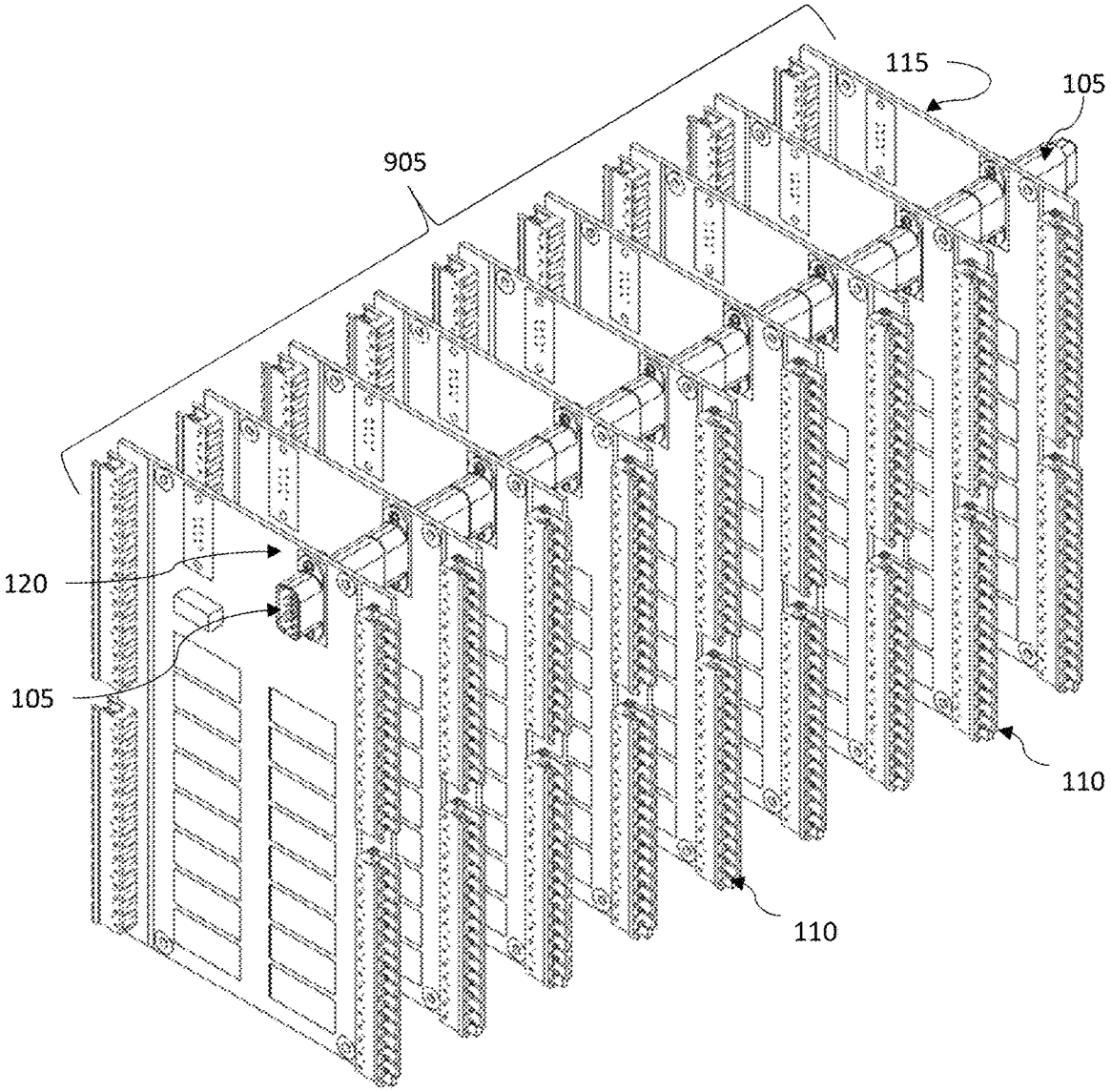
FIG. 9 is a diagram illustrating an isometric rear view of an exemplary embodiment of multiple PCBs connected via the dual-sided connector shown in FIGS. 1A and 1B
Figure 10:
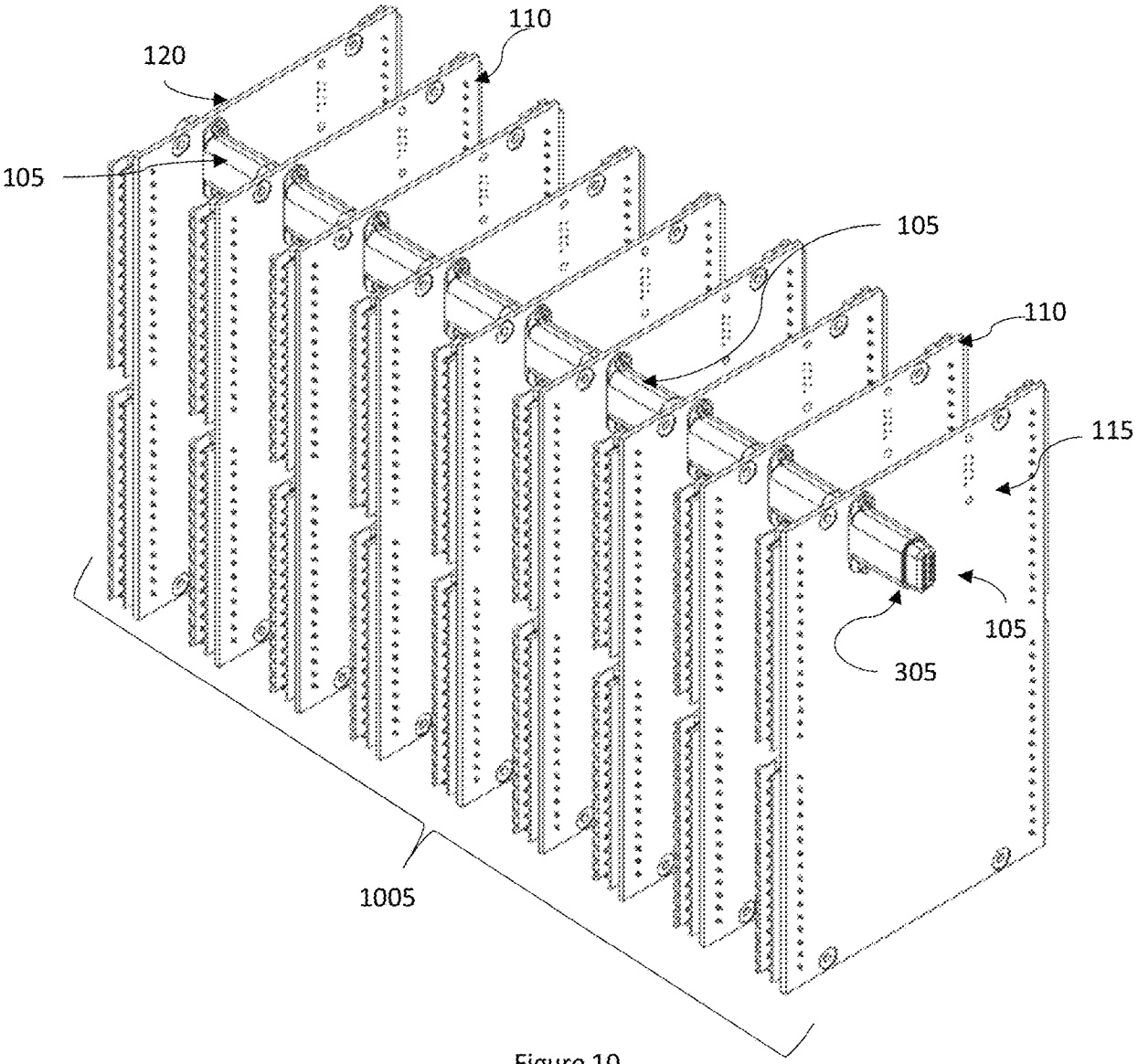
FIG. 10 is a diagram illustrating an isometric front view of the exemplary embodiment shown in FIG. 9.

FIG. 9 is a diagram illustrating an isometric rear view of an exemplary embodiment of multiple PCBs connected via the dual-sided connector shown in FIGS. 1A and 1B. As shown in FIG. 9, individual PCBs 110 can be coupled via the dual-sided connector 105 described herein. For example, the plurality of PCBs 905 are coupled together by connecting the female connection port 305 of a first dual-sided connector 105 extending through a first PCB 110 with the male connection port 315 of a second dual-sided connector 105 extending through a second PCB 110. In this way, the plurality of PCBs 905 can be communicatively coupled to share data and power transmitted to each of the individual PCBs via the dual-sided connector 105 linking two or more PCBs 110. FIG. 10 is a diagram illustrating an isometric front view of the exemplary embodiment shown in FIG. 9. As shown in FIG. 10, the female connection port 305 of the dual-sided connector 105 extending from the rear side 115 of each PCB 110 can couple with a male connection port 315 configured on a front side 120 of an adjacent PCB 110.

Figure 11:
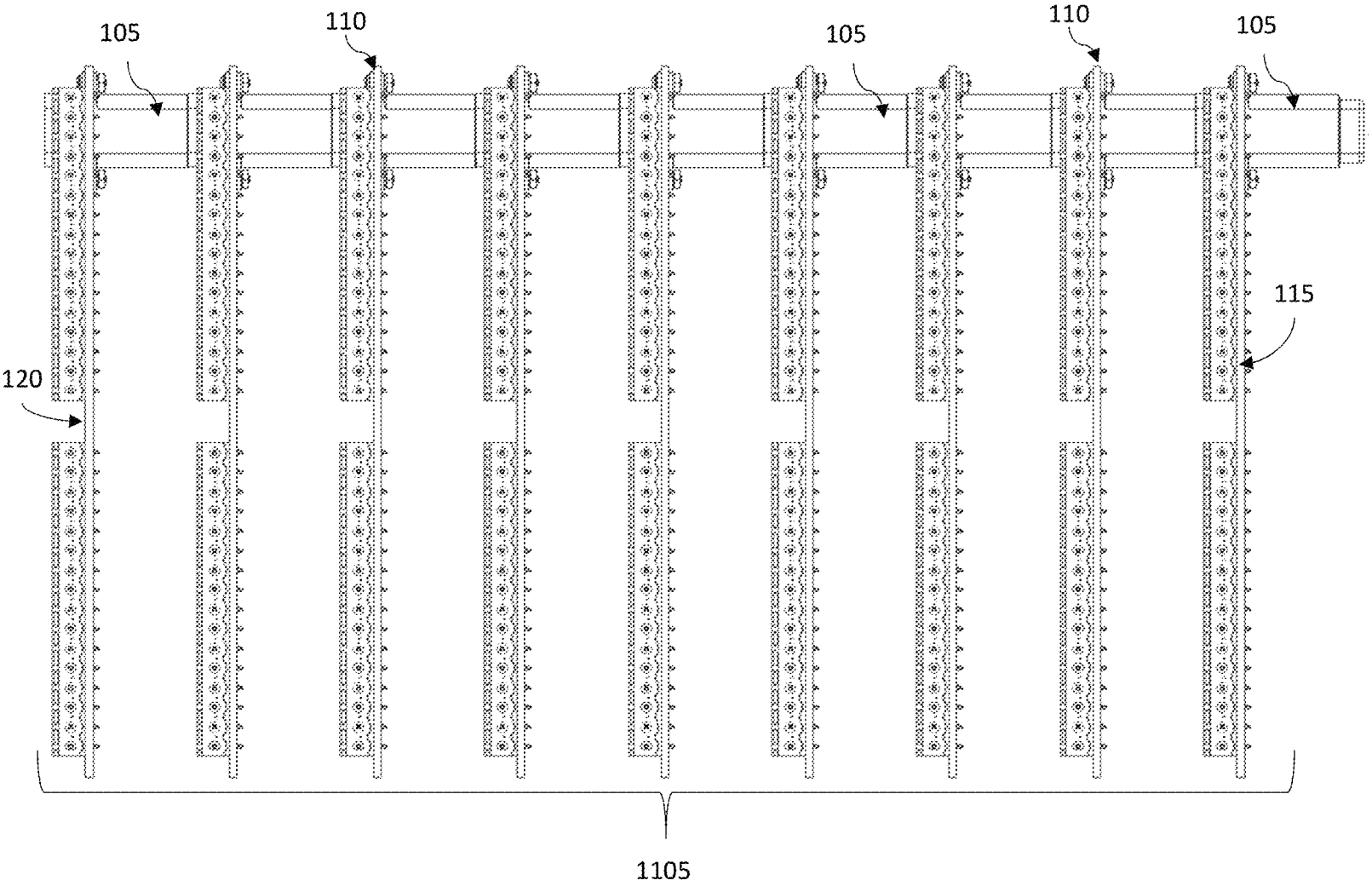
FIG. 11 is a diagram illustrating an isometric side view of the exemplary embodiment shown in FIG. 9.
Figure 12:
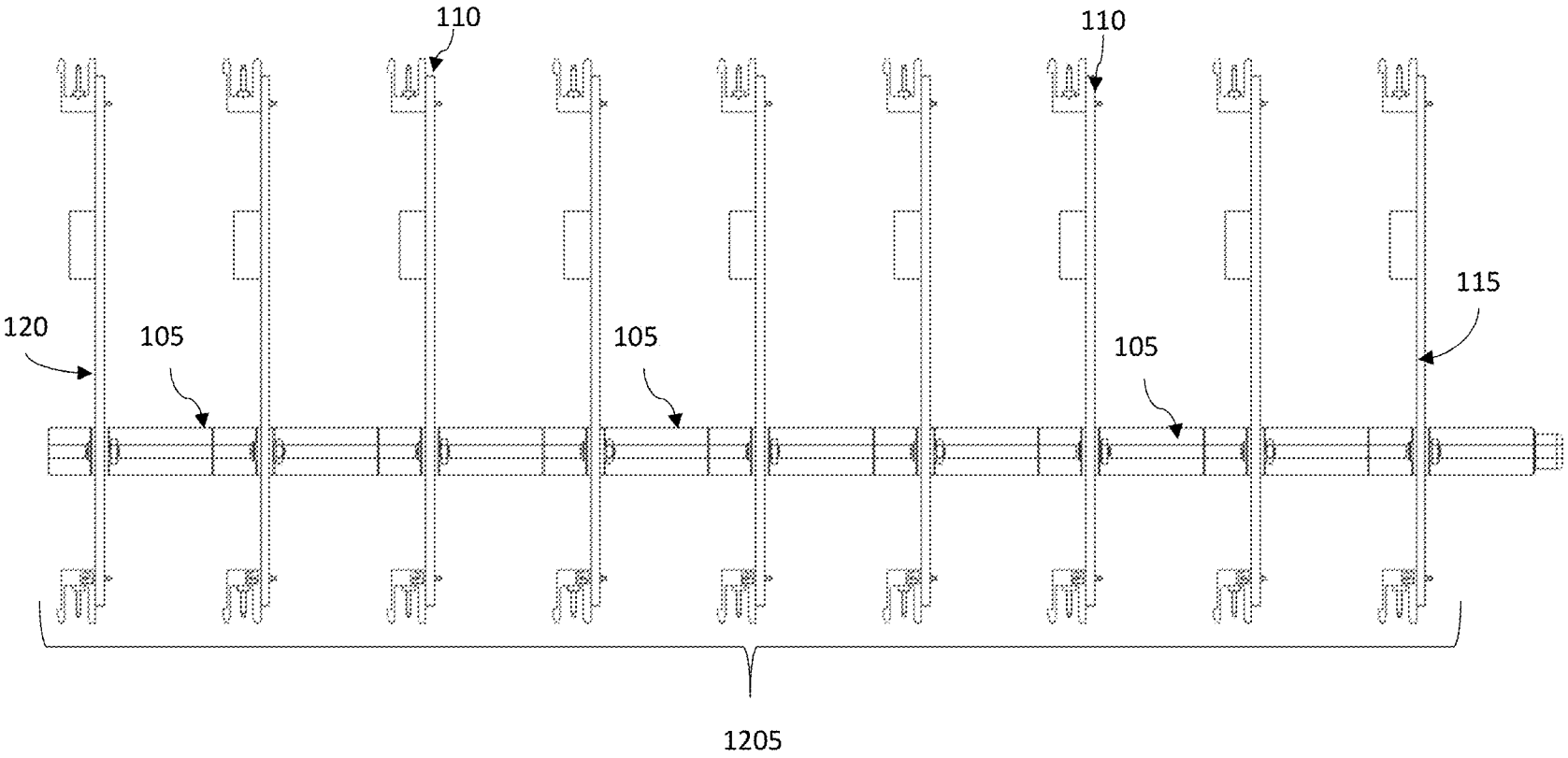
FIG. 12 is a diagram illustrating an isometric top view of the exemplary embodiment shown in FIG. 9.

FIG. 11 is a diagram illustrating an isometric side view of the exemplary embodiment shown in FIG. 9 linking multiple PCBs 1105 via individual dual-sided connectors 105 configured on the individual PCBs 110. FIG. 12 is a diagram illustrating an isometric top view of the exemplary embodiment shown in FIG. 9 showing a plurality of PCBs 1205 coupled via dual-sided connectors 105 as described herein.

Figure 13:
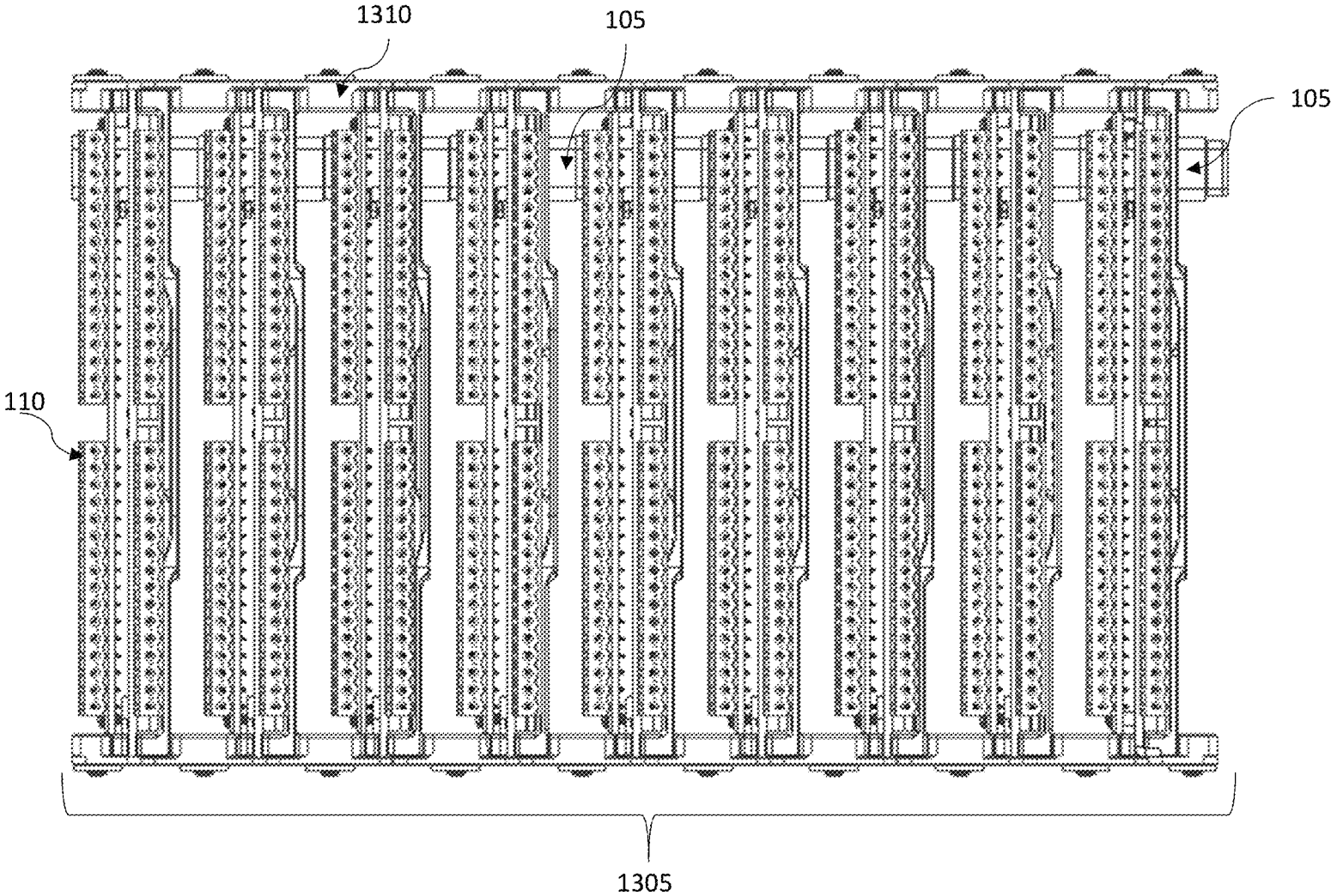
FIG. 13 is a diagram illustrating an isometric side view of an exemplary embodiment of multiple PCBs connected via the dual-sided connector described herein and coupled to a housing.

FIG. 13 is a diagram illustrating an isometric side view of an exemplary embodiment of multiple PCBs connected via the dual-sided connector described herein and coupled to a housing. The plurality of PCBs 1305 can be coupled via the dual-sided connectors 105 as described herein. The plurality of PCBs 1305 can be further coupled to a housing 1310. The housing 1310 may be configured within a rack or hardware mounting system associated with a control system, data acquisition system, or the like in which the PCBs 110 are configured to operate.

Figure 14B:
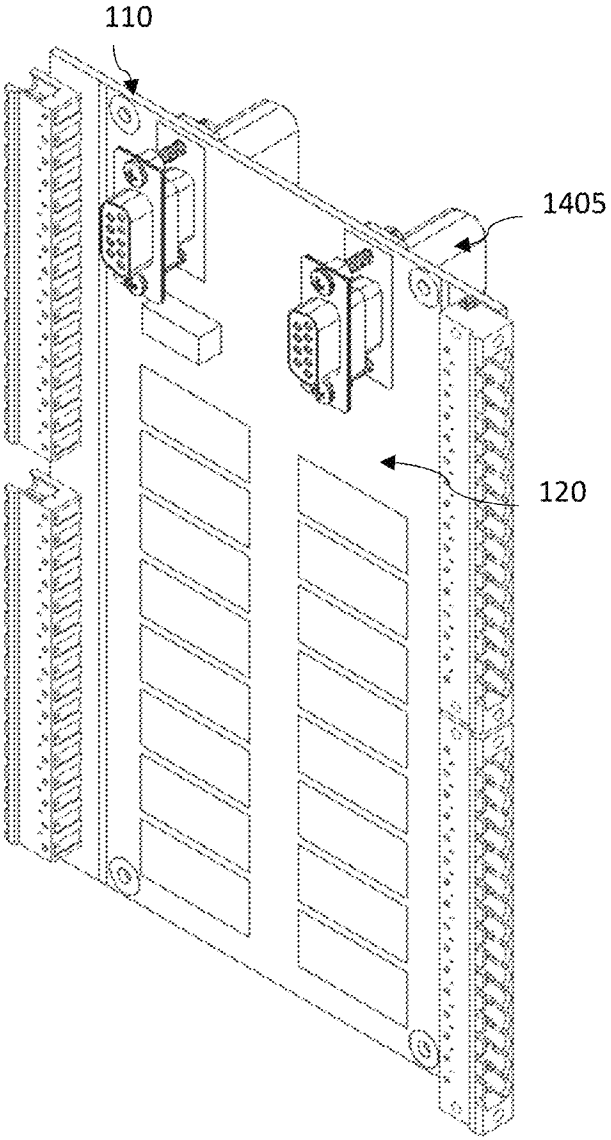
FIGS. 14A and 14B are diagrams illustrating isometric views of a second embodiment of a dual-sided connector as described herein.
Figure 14A:
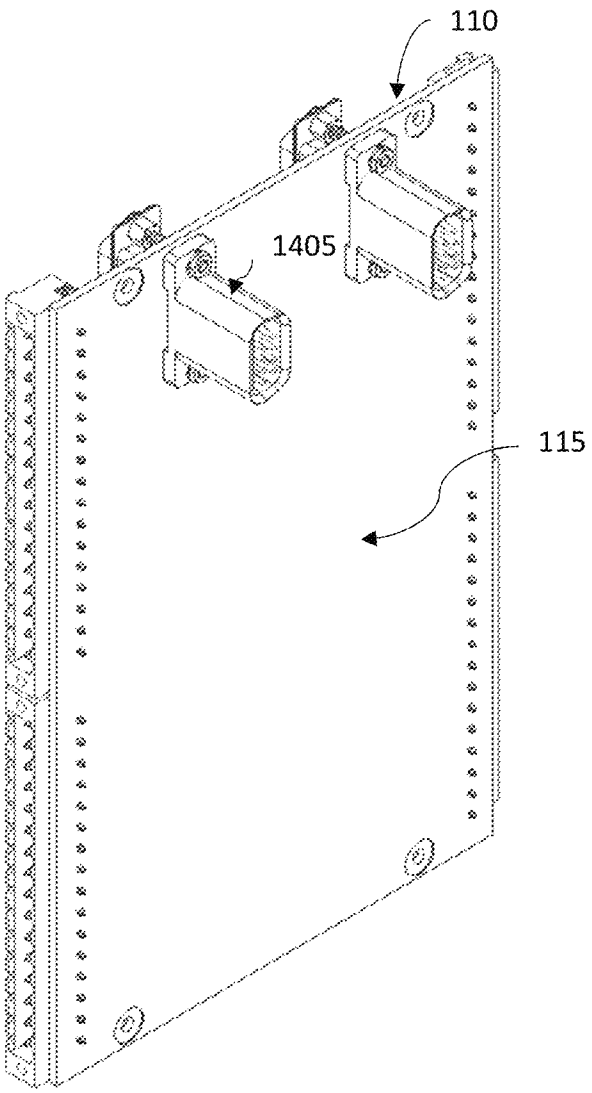

FIG. 14A is a diagram illustrating an isometric view of a second embodiment of a dual-sided connector 1405. The dual-sided connector 1405 can be configured within a through hole of a PCB 110. The through hole of the PCB can be plated through holes. As shown in FIG. 14A, the dual-sided connector 1405 can extend through the PCB 110 to the rear side 115 of the PCB 110. As shown in FIG. 14B, the dual-sided connector 1405 can extend through the front side 120 of the PCB 110. The dual-sided connector 1405 can be configured to utilize the same PCB through hole configured on the PCB 110 for single-sided connectors. In some embodiments, the PCB 110 can include multiple through holes and thus, multiple dual-sided connectors 1405 can be configured on a single PCB 110. The dual-sided connector 1405 can be configured as a serial connector to serially link or couple two or more PCBs 110 to each other, thereby allowing multiple PCBs and the PCB circuits respectively configured on each PCB 110 to share power and data transmissions efficiently without complex, custom cabling or specialized adapter or connector components.

Figure 15B:
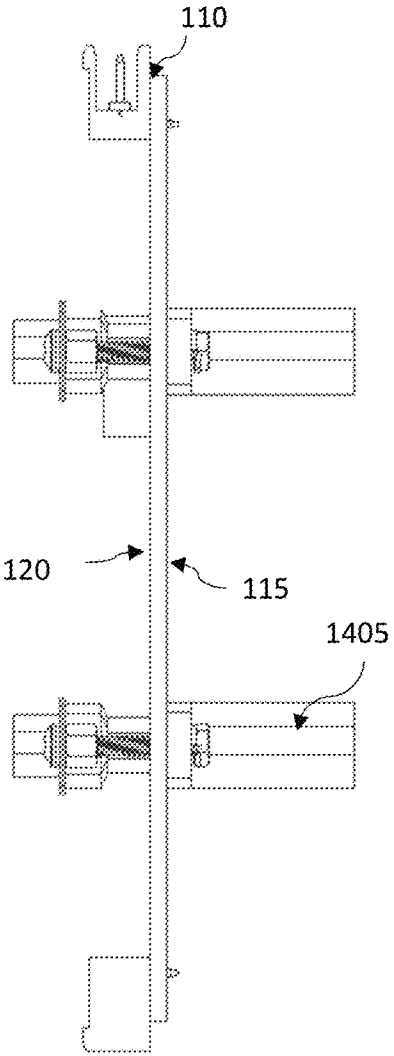
FIG. 15B is a diagram illustrating a top-down view of the second embodiment of the dual-sided connector shown in FIGS. 14A and 14B.
Figure 15A:
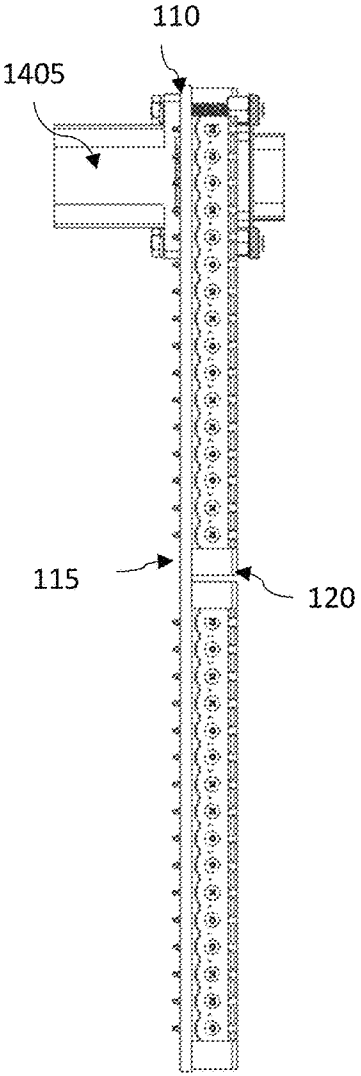
FIG. 15A is a diagram illustrating a side view of the second embodiment of the dual-sided connector shown in FIGS. 14A and 14B.

FIG. 15A is a diagram illustrating a side view of the second embodiment of the dual-sided connector 1405 shown in FIGS. 14A and 14B. FIG. 15B is a diagram illustrating a top-down view of the exemplary embodiment of the dual-sided connector shown in FIGS. 14A and 14B. As shown in FIGS. 15A and 15B, the dual sided connector 1405 extends through the PCB 110.

Figure 16:
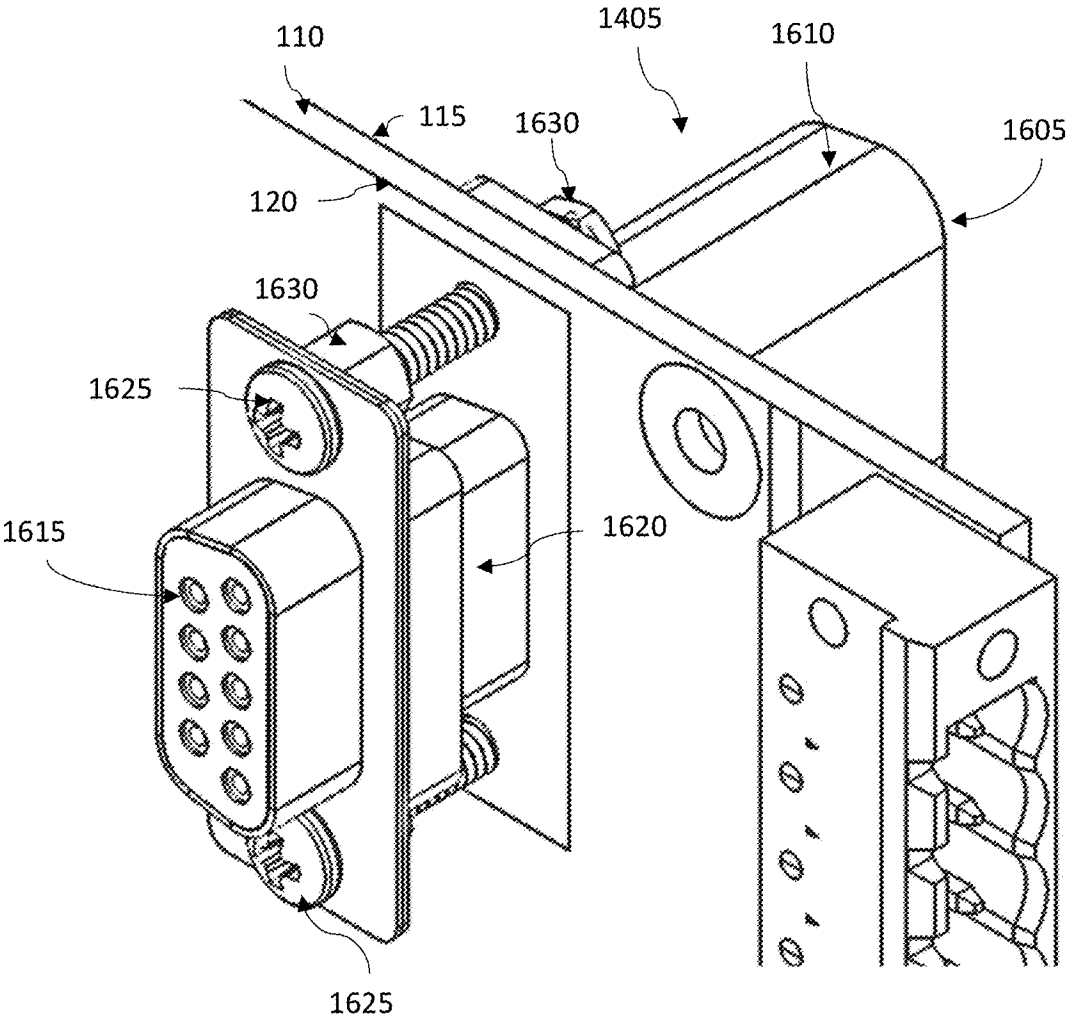
FIG. 16 is a diagram illustrating an isometric close-up view of the second embodiment of the dual-sided connector shown in FIGS. 14A and 14B.

FIG. 16 is a diagram illustrating an isometric close-up view of the second embodiment of the dual-sided connector 1405 shown in FIGS. 14A and 14B. As shown in FIG. 16, the dual-sided connector 1405 can include a male connection port 1605 configured with respect to a rear side 115 of the PCB 110. A male connection port housing 1610 can house or enclose the male connection port 1605. The dual-sided connector 1405 can also include a female connection port 1615 configured with respect to a front side 120 of the PCB 110. The female connection port 1615 is housed or enclosed by a female connection port housing 1620. In some embodiments, the orientation of the dual-sided connector 1405 can be transposed with respect to the PCB 110. For example, in some embodiments, the male connection port 1605 can be configured with respect to the front side 120 of the PCB 110 and the female connection port 1615 can be configured with respect to the rear side 115 of the PCB 110.

As shown in FIG. 16, the female connection port housing 1620 can be positioned to surround a plurality of pins configured within the dual-sided connector 1405. Openings in the ends of the pins can be exposed within the female connection port housing 1620. The female connection port housing 1620 can be attached to the PCB 110 via a plurality of bolts 1625. The bolts 1625 can extend through the PCB 110 and can secure the dual-sided connector 1405 to the PCB via one or more nuts 1630. In some embodiments, the female connection port housing 1620 can be secured to the PCB 110 via a variety of fasteners, such as rivets, screws, press-on fittings, friction fittings, or the like. The male connection port housing 1610 and the female connection port housing 1620 can be formed via injection molding, machining, or a combination thereof. The connection port housings 1610 and 1620 can secure the pins within the respective housings by over-molding, insertion-molding, or press-fitting the pins within the housings 1610 and 1620.

Figure 17C:
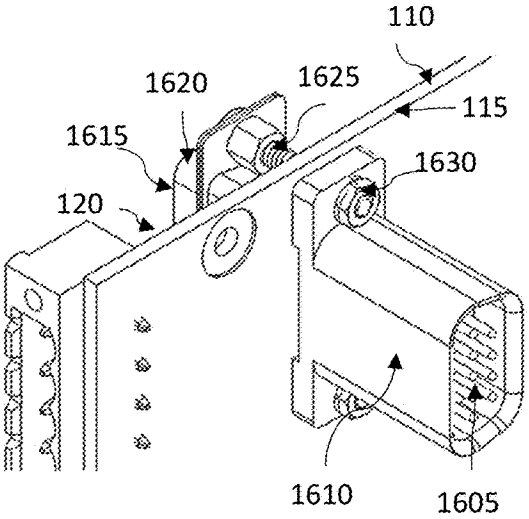
FIGS. 17A-17C are diagrams illustrating isometric views of assembling the dual-sided connector shown in FIGS. 14A and 14B.
Figure 17B:
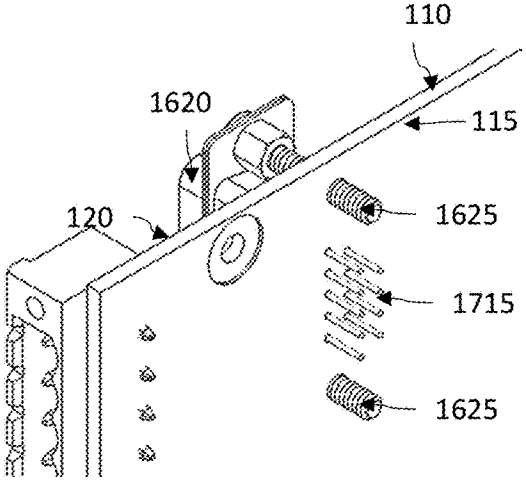
Figure 17A:
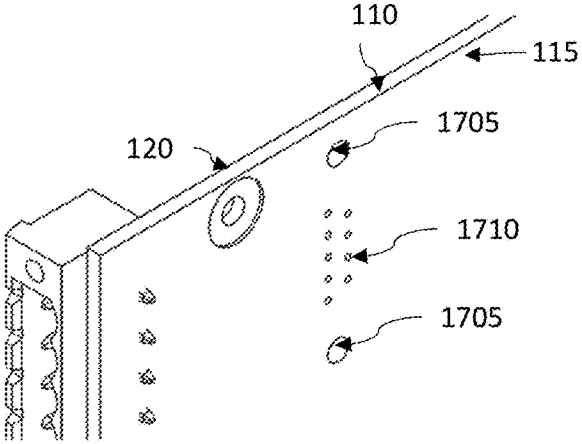

FIGS. 17A-17C are diagrams illustrating isometric views of the second embodiment of the dual-sided connector 1405 shown in FIGS. 14A and 14B. FIGS. 17A-17C can illustrate a workflow or method of assembling the dual-sided connector 1405 onto a PCB 110.

As shown in FIG. 17A, the PCB 110 can include a plurality of through holes 1705. The PCB can also include a plurality of pin holes 1710. As shown in FIG. 17B, the female connection port housing 1620 can be configured with fasteners 1625. The fasteners 1625 and the female connection port housing 1620 can inserted into the through holes 1705 and pin holes 1710, respectively, and can extend through to the opposite side of the PCB 110. The pins 1715 can be the tail ends of a first set of pins that can be configured within the female connection port housing 1620 of the dual-sided connector 1405.

As shown in FIG. 17C, the male connection port housing 1610 can be secured to the PCB 110 via securing mechanisms, such as nut 1630. The male connection port housing 1610 can include a second set of pins. The second set of pins can couple with the pins 1715 included in the first set of pins arranged within the female connection port housing 1620. The second set of pins can terminate at an opposite end of their coupling with pins 1715 and can form the male connection port 1605 at this opposite end.

Figure 18B:
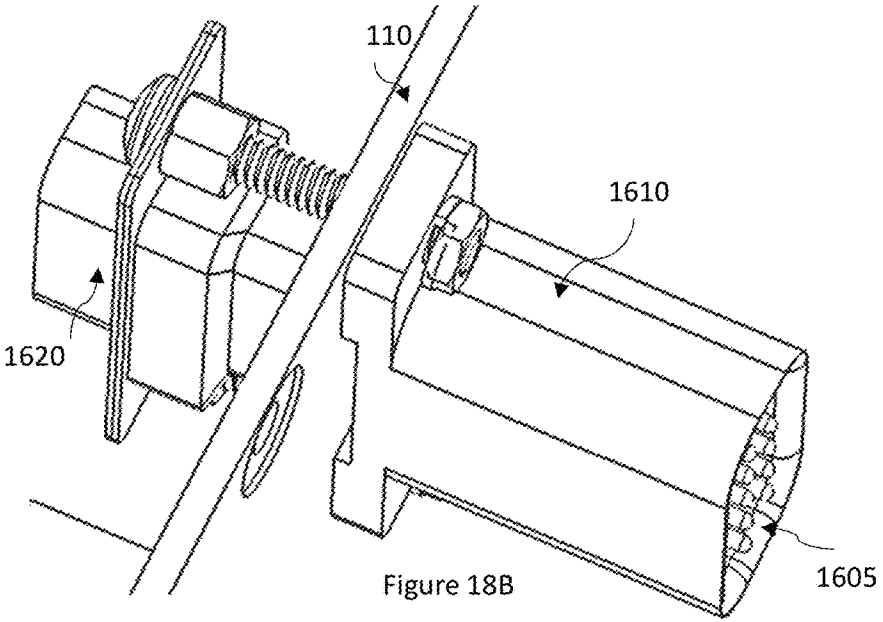
FIGS. 18A-18B are diagrams illustrating isometric close-up views of the exemplary embodiment of the dual-sided connector shown in FIGS. 14A and 14B.
Figure 18A:
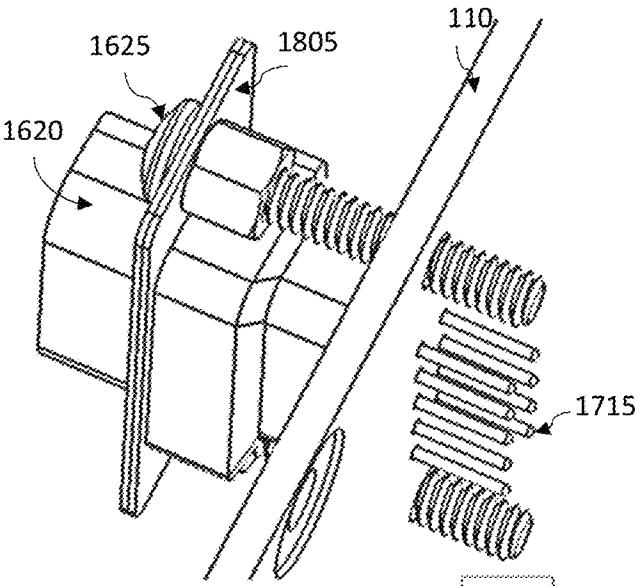

FIGS. 18A-18B are diagrams illustrating isometric close-up views of the second embodiment of the dual-sided connector 1405 shown in FIGS. 14A and 14B. As shown in FIG. 18A, the female connection port housing 1620 and fasteners 1625 can be inserted into the PCB 110 such that pins 1715 protrude through the PCB 110. The pins 1715 can couple with a second set of pins included in the male connection port housing 1610. The female connection port housing 1620 can include a flange 1805 to which the fasteners 1625 can exert force against when securing the housings 1610 and 1620 with respect to one another onto the PCB. In some embodiments, the male connection port housings 1610 and/or the female connection port housings 1620 can be D-subminiature type connectors. In some embodiments, the male connection port housings 1610 and/or the female connection port housings 1620 can include extended solder tail pins. As shown in FIG. 18B, the male connection port housing 1610 can be applied onto the PCB 110 and secured thereto.

Figure 18C:
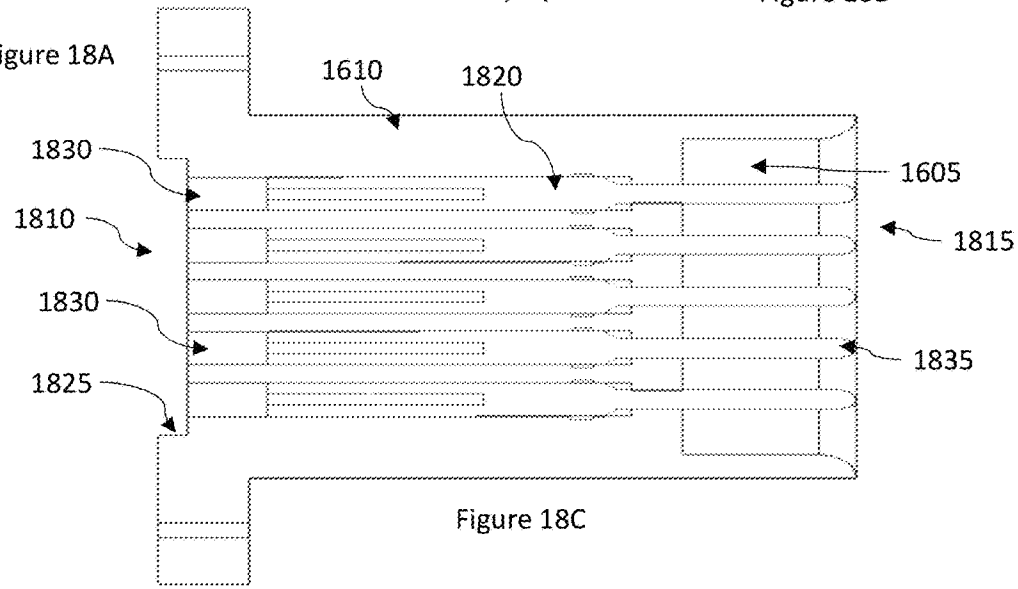
FIG. 18C is a diagram illustrating a cross-sectional view of the male connection port housing of the dual-sided connector of FIGS. 14A and 14B.

FIG. 18C is a diagram illustrating a cross-sectional view of the male connection port housing 1610 of the dual-sided connector 1405 of FIGS. 14A and 14B. As shown in FIG. 18C, the male connection port housing 1610 can include a first end 1810 and a second end 1815. The male connection port housing 1610 can include a plurality of pins 1820. The pins 1820 can be over-molded, insertion-molded, or press-fit within the male connection port housing 1610. At the first end 1810, the male connection port housing 1610 can also include a recess 1825. The recess 1825 can be configured in the first end 1810 of the male connection port housing 1610 to allow room for solder cones present on the solder tails to fit within the male connection port housing 1610. The recesses 1830 can receive pins 1715 of the female connection port housing 1620. The recesses 1830 can be configured to account for tolerance ranges of the male connection port housing 1610 and the pins 1820. At the second end 1815, the pins 1820 can include a male end 1835.

Figure 19B:
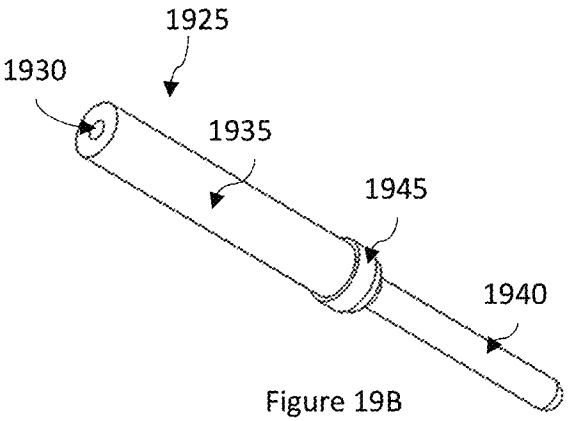
FIGS. 19A-19D are diagrams illustrating exemplary embodiments of pins included in the dual-sided connector shown in FIGS. 14A-14B.
Figure 19D:
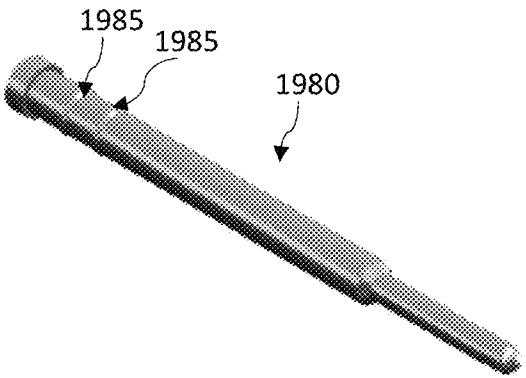
Figure 19A:
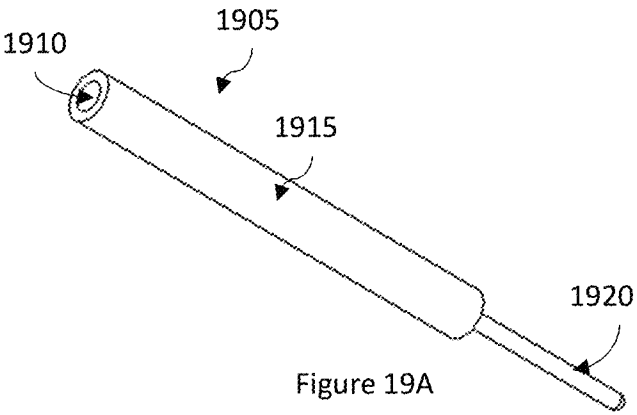

FIGS. 19A-19D are diagrams illustrating exemplary embodiments of pins included in the dual-sided connector 1405 shown in FIGS. 14A-14B. The pins shown in FIGS. 19A-19B can be configured in the female connection port housing 1620. The pins shown in FIGS. 19C-19D can be configure in the male connection port housing 1610. As shown in FIG. 19A, the pin 1905 can include a female end 1910 configured with a cavity. The male end of an adjacent pin can be inserted into the female end 1910. The pin 1905 can also include a central body portion 1915 and a male end 1920. The male end 1920 can be received within a female end of an adjacent pin. As shown in FIG. 19B, the pin 1925 can include a female end 1930, a central body portion 1935, and a male end 1940. The pin 1925 can also include a protruding portion 1945. In some embodiments, the protruding portion can be a collar or ferrule. The protruding portion 1925 can abut the PCB 110 when the female connection port housing 1620 is secured against the PCB 110.

Figure 19C:
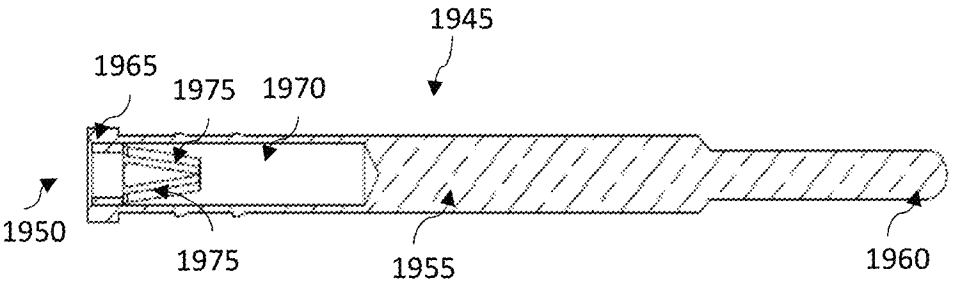

As shown in FIG. 19C, pin 1945 can include a female end 1950, a central body portion 1955, and a male end 1960. In some embodiments, the male end 1960 can include a tapered profile or a tapered portion along the length of the male end 1960. The pin 1945 can also include a socket 1965 that can be inserted into a cavity 1970 formed within a portion of the central body portion 1955. In some embodiments, socket 1965 can be secured to pin 1945 via press fitting, welding, gluing, or via a spring force. The socket 1965 can include one or more flange structures 1975 which can protrude into the cavity 1970. The flange structures 1975 can secure the male end of a pin, such as male end 1920 of pin 1905 in FIG. 19A, within the cavity 1970. In this way, pins of the female connection port housing shown in FIGS. 19A-19B can couple with pins of the male connection port housing shown in FIGS. 19C-19D. As shown in FIG. 19D, the pin 1980 can include a plurality of protrusions 1985 for securing the pin 1980 within the male connection port housing, such as male connection port housing 1610 of FIGS. 18B and 18C. In some embodiments, the pins 1905, 1925, 1945, and 1980 can be formed by machining or rolling flat stock of metal material or by extrusion.

Figure 20:
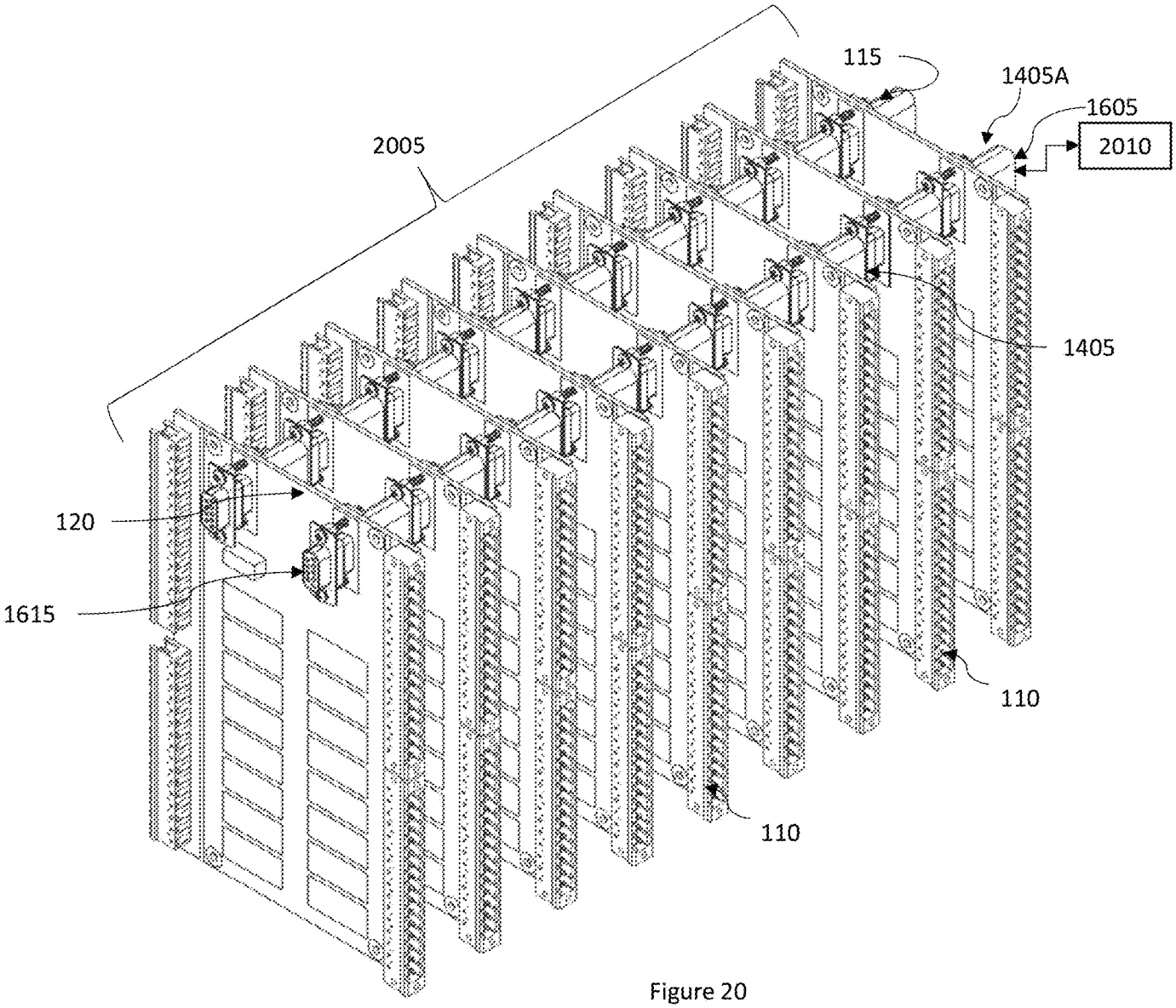
FIG. 20 is a diagram illustrating an isometric rear view of an exemplary embodiment of multiple PCBs connected via the dual-sided connector shown in FIGS. 14A and 14B.

FIG. 20 is a diagram illustrating an isometric rear view of a second embodiment of multiple PCBs connected via the dual-sided connector 1405 shown in FIGS. 14A and 14B. FIG. As shown in FIG. 20, individual PCBs 110 can be coupled via the dual-sided connector 1405 described herein. For example, the plurality of PCBs 2005 are coupled together by connecting the female connection port 1615 of a first dual-sided connector 1405 extending through a first PCB 110 with the male connection port 1605 of a second dual-sided connector 1405 extending from and through a second PCB 110. In this way, the plurality of PCBs 2005 can be communicatively coupled to share data and power transmitted to each of the individual PCBs via the dual-sided connector 1405 linking two or more PCBs 110. As further shown in FIG. 20, the male connection port 1605 of a first dual-sided connector 1405A can be coupled to a control system 2010.

Figure 21:
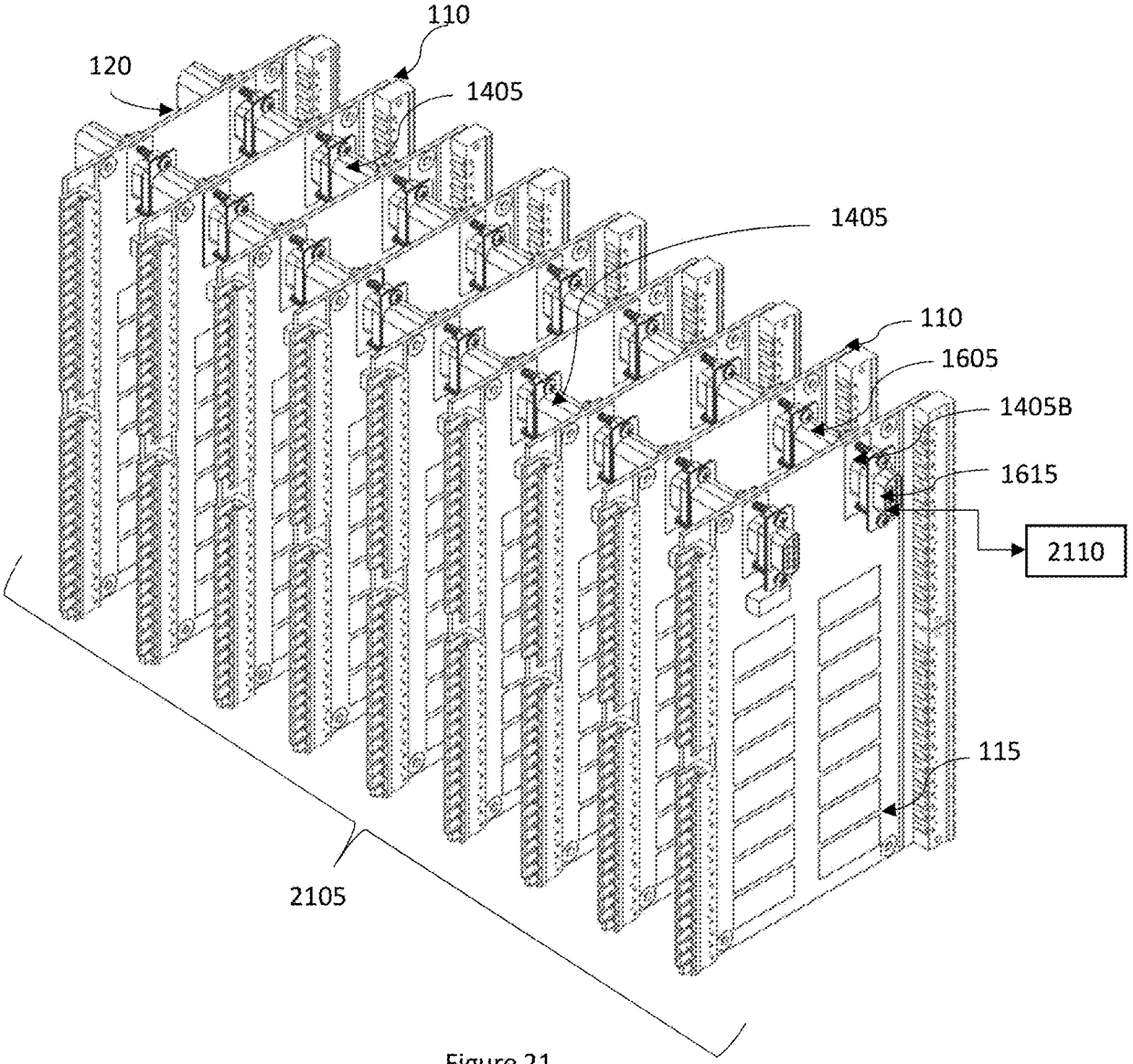
FIG. 21 is a diagram illustrating an isometric front view of the exemplary embodiment shown in FIG. 20.

FIG. 21 is a diagram illustrating an isometric front view of the second embodiment shown in FIG. 20. As shown in FIG. 21, the female connection port 1615 of the dual-sided connector 1405 extending from the rear side 115 of each PCB 110 can couple with a male connection port 1605 configured on a front side 120 of an adjacent PCB 110. As further shown in FIG. 21, the female connection port 1615 of a second dual-sided connector 1405B can be coupled to a control system 2110.

Figure 22:
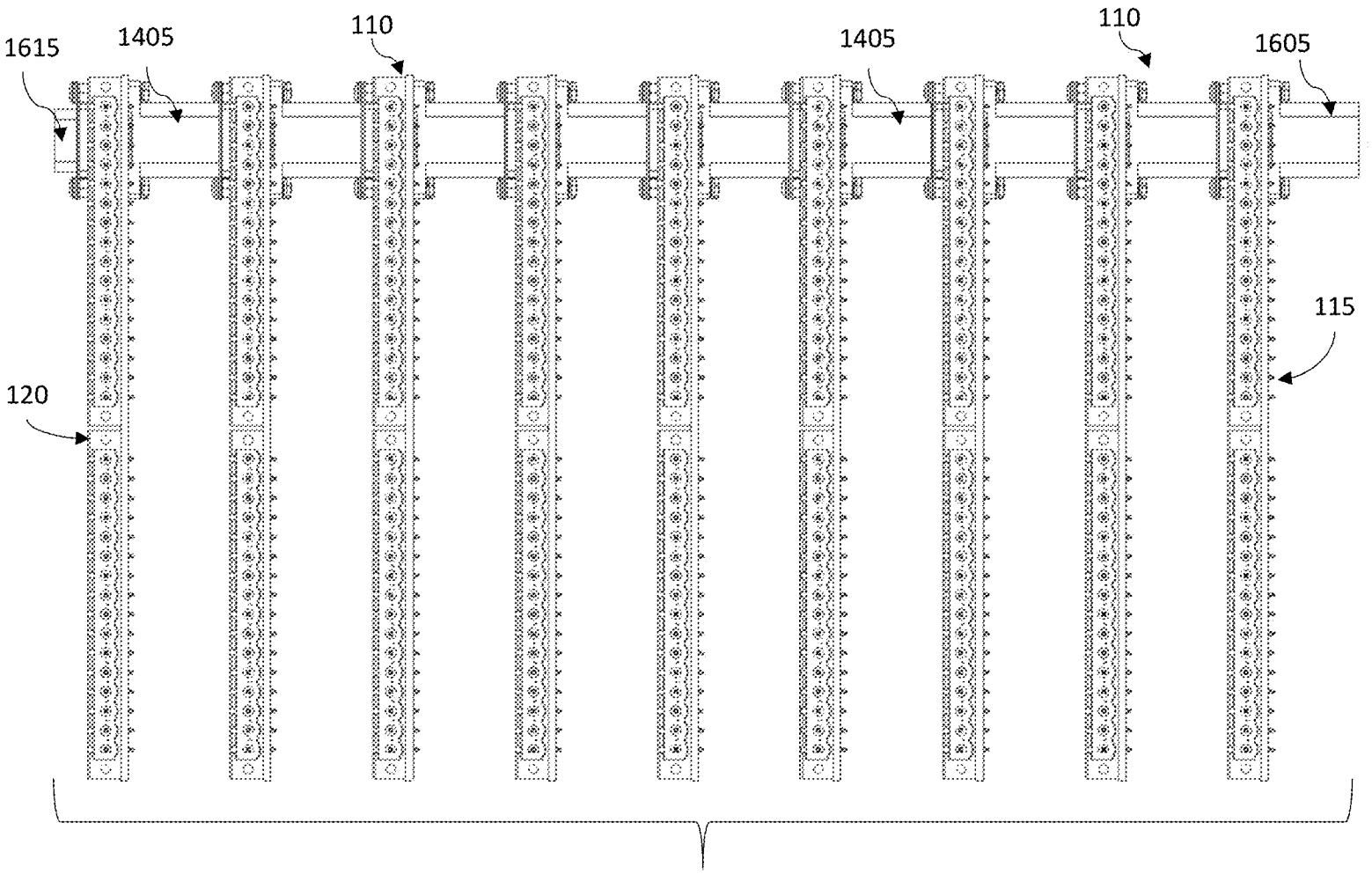
FIG. 22 is a diagram illustrating an isometric side view of the exemplary embodiment shown in FIG. 20.
Figure 23:
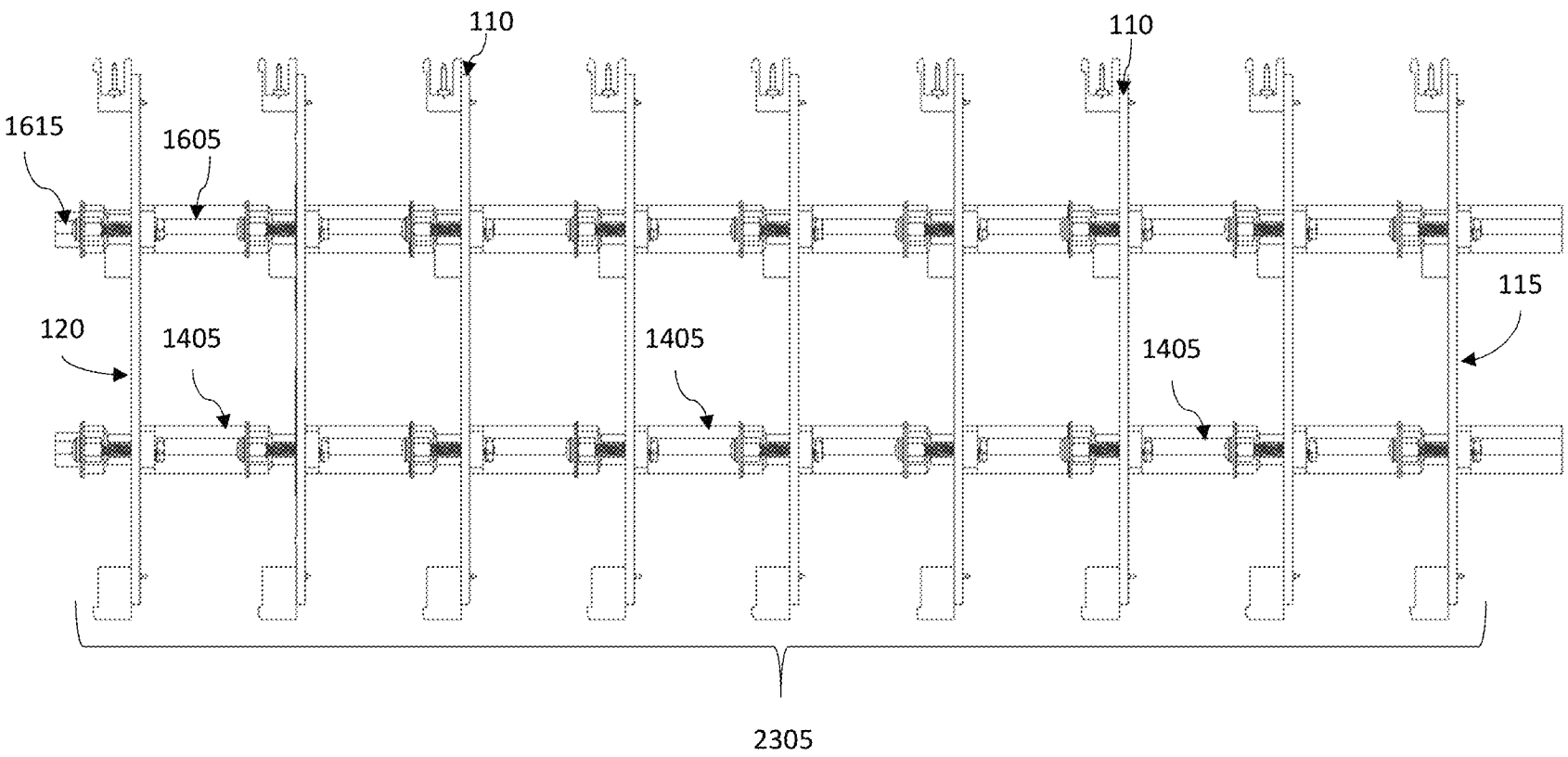
FIG. 23 is a diagram illustrating an isometric top view of the exemplary embodiment shown in FIG. 20.

FIG. 22 is a diagram illustrating an isometric side view of the second embodiment shown in FIG. 20 linking multiple PCBs 2205 via individual dual-sided connectors 1405 configured on the individual PCBs 110. FIG. 23 is a diagram illustrating an isometric top view of the second embodiment shown in FIG. 20 showing a plurality of PCBs 2305 coupled via dual-sided connectors 1405 as described herein.

The improved system, devices, and methods described herein addresses the technical problem of coupling multiple PCBs using existing through holes configured on each PCB for single-sided serial connectors without redesigning PCB through hole arrangements which can be costly, time-consuming and can reduce the structural integrity of the PCB. The exemplary technical effects of the methods, systems, and devices described herein also include, by way of non-limiting example, providing a double-sided connector capable of allowing multiple PCBs to be stacked in a reduced footprint. By stacking multiple PCBs in smaller spaces, the need for custom, complex serial cabling between the PCBs is avoided. As a result, data and power transmission rates between PCBs can be increased and the operating performance of the PCBs, as well as the systems in which they are deployed, can be improved compared to systems using long, complex, customized serial cables to connect multiple PCBs.

Certain exemplary embodiments have been described to provide an overall understanding of the principles of the structure, function, manufacture, and use of the systems, devices, and methods disclosed herein. One or more examples of these embodiments have been illustrated in the accompanying drawings. Those skilled in the art will understand that the systems, devices, and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention. Further, in the present disclosure, like-named components of the embodiments generally have similar features, and thus within a particular embodiment each feature of each like-named component is not necessarily fully elaborated upon.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

One skilled in the art will appreciate further features and advantages of the invention based on the above-described embodiments. Accordingly, the present application is not to be limited by what has been particularly shown and described, except as indicated by the appended claims. All publications and references cited herein are expressly incorporated by reference in their entirety.

What is claimed is:

1. A dual-sided connector comprising:

a first housing including a male connection port;

a second housing opposite the first housing, the second housing including a female connection port;

a plurality of pins included in the second housing and extending through the first housing and the second housing, each pin of the plurality of pins including a male end terminating in the first housing and a female end terminating in the second housing; and a plurality of fasteners coupling the first housing and the second housing.

2. The dual-sided connector of claim 1, wherein the male connection port couples with a second female connection port of a first adjacent dual-sided connector and the female connection port couples with a second male connection port of a second adjacent dual-sided connector.

3. The dual-sided connector of claim 1, wherein the dual-sided connector is a D-subminiature connector.

4. The dual-sided connector of claim 1, wherein the male end of each pin of the plurality of pins extends through a pin hole of a printed circuit board (PCB).

5. The dual-sided connector of claim 4, wherein each pin of the plurality of pins includes a collar between the female end and the male end, the collar abutting the PCB when the first housing is coupled to the second housing.

6. The dual-sided connector of claim 1, wherein the male end of each pin of the plurality of pins include a tapered portion.

7. The dual-sided connector of claim 1, wherein the first housing and/or the second housing are formed via injection molding, machining, or a combination thereof.

8. The dual-sided connector of claim 1, wherein the plurality of pins are secured within the second housing via over-molding, insertion molding, or press fitting.

9. A dual-sided connector comprising:

a first housing including a female connection port;

a second housing opposite the first housing, the second housing including a male connection port;

a first plurality of pins included in the first housing, the first plurality of pins extending through the first housing and into the second housing, each pin of the first plurality of pins including a female end terminating in the first housing and a tail end terminating in the second housing;

a second plurality of pins included in and extending through the second housing, each pin of the second plurality of pins including a socket end and a male end, the socket end including a socket; and a plurality of fasteners coupling the first housing and the second housing.

10. The dual-sided connector of claim 9, wherein the male connection port couples with a second female connection port of a first adjacent dual-sided connector and the female connection port couples with a second male connection port of a second adjacent dual-sided connector.

11. The dual-sided connector of claim 9, wherein the second housing is a D-subminiature connector.

12. The dual-sided connector of claim 9, wherein the tail end of each pin of the first plurality of pins extends through a pin hole of a printed circuit board (PCB).

13. The dual-sided connector of claim 12, wherein each pin of the first plurality of pins includes a collar between the female end and the tail end, the collar abutting the PCB when the first housing is coupled to the second housing.

14. The dual-sided connector of claim 9, wherein the male end of each pin of the second plurality of pins include a tapered portion.

15. The dual-sided connector of claim 9, wherein the first housing and/or the second housing are formed via injection molding, machining, or a combination thereof.

16. The dual-sided connector of claim 9, wherein the first plurality of pins are secured within the first housing via over-molding, insertion molding, or press fitting and/or the second plurality of pins are secured within the second housing via over-molding, insertion molding, or press fitting.

17. The dual-sided connector of claim 9, wherein the socket end includes a cavity and a plurality of flange structures within the cavity.

18. The dual-sided connector of claim 17, wherein the tail end of a respective pin of the first plurality of pins is received within the cavity and secured within the cavity by the plurality of flange structures.

19. A system comprising:

a first dual-sided connector including a first housing including a female connection port;

a second housing including a male connection port;

a first plurality of pins included in the first housing, the first plurality of pins extending through the first housing and into the second housing, each pin of the first plurality of pins including a female end terminating in the first housing and a tail end terminating in the second housing;

a second plurality of pins included in and extending through the second housing, each pin of the second plurality of pins including a socket end and a male end, the socket end including a socket; and a plurality of fasteners coupling the first housing and the second housing; and at least two printed circuit boards (PCBs); wherein the first dual-sided connector is coupled to a first PCB via the plurality of fasteners extending through holes in the first PCB, and the male connection port of the first dual-sided connector coupled to the first PCB is coupled to a second female connection port of a second dual-sided connector of a second PCB adjacent to the first PCB.

20. The system of claim 19, wherein the system is coupled to a control system via the male connection port of the first dual-sided connector or the second female connection port of the second dual-sided connector.

* * * * *